US008201930B2

(12) United States Patent
Yokouchi

(10) Patent No.: US 8,201,930 B2
(45) Date of Patent: Jun. 19, 2012

(54) LIQUID SUPPLY DEVICE, LIQUID EJECTING APPARATUS, AND LIQUID SUPPLYING METHOD

(75) Inventor: Hideya Yokouchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 384 days.

(21) Appl. No.: 12/507,654

(22) Filed: Jul. 22, 2009

(65) Prior Publication Data

US 2010/0020139 A1 Jan. 28, 2010

(30) Foreign Application Priority Data

Jul. 23, 2008 (JP) ..... 2008-190201

(51) Int. Cl.
*B41J 2/175* (2006.01)

(52) U.S. Cl. ..... 347/85

(58) Field of Classification Search ..... 347/66, 347/84, 85; 141/2, 118
See application file for complete search history.

(56) References Cited

U.S. PATENT DOCUMENTS 6,322,207 B1 * 11/2001 Hall et al. ..... 347/85
6,676,006 B2 * 1/2004 Ishida ..... 228/42
6,773,099 B2 * 8/2004 Inoue et al. ..... 347/86
7,524,044 B2 * 4/2009 Kumagai ..... 347/85

FOREIGN PATENT DOCUMENTS

JP 09-164698 6/1997
JP 2007-313806 12/2007

* cited by examiner

*Primary Examiner* — Anh T. N. Vo
(74) *Attorney, Agent, or Firm* — Workman Nydegger

(57) ABSTRACT

A liquid supply device includes a liquid supply passage which supplies a liquid from an upstream side on which the liquid is supplied from a liquid supply source to a downstream side on which the liquid is consumed. A pump is provided with a pump chamber in the liquid supply passage. A displacement member forms a part of a wall surface of the pump chamber and is displaceable to increase or decrease the volume of the pump chamber. An urging member urges the displacement member in a direction decreasing the volume of the pump chamber. A displacement mechanism displaces the displacement member in a direction increasing the volume of the pump chamber against an urging force of the urging member upon driving the displacement mechanism. Upon stopping the drive of the displacement mechanism, the pump chamber remains in a pressurized state by the urging force of the urging member.

7 Claims, 20 Drawing Sheets

LIQUID SUPPLY DEVICE, LIQUID EJECTING APPARATUS, AND LIQUID SUPPLYING METHOD

The entire disclosure of Japanese Patent Application No. 2008-190201, filed Jul. 23, 2008, is expressly incorporated herein by reference.

BACKGROUND

1. Technical Field

The present invention relates to a liquid supply device, a liquid ejecting apparatus, and a liquid supplying method.

2. Related Art

In the past, there was known an ink jet printer (hereinafter, referred to as "a printer") as a liquid ejecting apparatus for ejecting a liquid onto a target. The printer performs printing on a print medium as the target by ejecting ink (a liquid) supplied to a printing head (a liquid ejecting unit) through nozzles formed in the printing head. In recent years, as disclosed in JP-A-9-164698, for example, there has been suggested a printer in which a pump driven to pressurize and supply ink to a printing head from an ink cartridge is formed in an ink passage (a liquid supply passage) connecting an ink cartridge (a liquid supply source) to the printing head.

That is, in the printer disclosed in JP-A-9-164698, a pump chamber of the pump is provided in an ink passage. An ink introducing port for introducing the ink from the ink cartridge and an ink lead-out port for leading out the ink to the printing head are provided in the pump chamber. In addition, a part of the wall surface of the pump chamber is formed by a diaphragm. A spring urging the diaphragm in a direction in which the volume of the pump chamber is increased is provided in the pump chamber.

An actuator provided outside the pump chamber pressurizes the diaphragm against the urging force of the spring and displaces the diaphragm in a direction in which the volume of the pump chamber is decreased to supply the ink in the pump chamber from the ink lead-out port to the printing head. In addition, when the pressurizing of the actuator is released, the urging force of the spring displaces the diaphragm in the direction in which the volume of the pump chamber is increased to introduce the ink from the ink cartridge to the pump chamber through the ink introducing port.

In this printer, however, air may permeate into the ink passage due to the configuration of the printer when the ink cartridge is exchanged, for example, and thus bubbles may occur and remain in the pump chamber provided in the ink passage. Moreover, when the bubbles remain in the pump chamber, air flowing with the ink or air permeating through the wall surface may result in greatly increasing the bubbles. When these bubbles are present in the pump chamber, the bubbles absorb the variation of pressure caused by the displacement of the diaphragm. Therefore, the supply of the ink to the printing head may deteriorate. Furthermore, when the increased bubbles flow toward the printing head, a problem may occur in that a print quality deteriorates due to dot omission or the like.

SUMMARY

An advantage of some aspects of the invention is that it provides a liquid supply device capable of preventing bubbles from remaining in a pump chamber provided in a liquid supply passage and a liquid ejecting apparatus including the liquid supply device.

According to an aspect of the invention, there is provided a liquid supply device comprising: a liquid supply passage which supplies a liquid from an upstream side on which the liquid is supplied from a liquid supply source to a downstream side on which the liquid is consumed; a pump which is provided with a pump chamber in the liquid supply passage; a displacement member which forms a part of a wall surface of the pump chamber and is displaceable to increase or decrease the volume of the pump chamber; an urging member which urges the displacement member in a direction decreasing the volume of the pump chamber; and a displacement mechanism which displaces the displacement member in a direction increasing the volume of the pump chamber against an urging force of the urging member upon driving the displacement mechanism. Upon stopping the drive of the displacement mechanism, the pump chamber remains in a pressurized state by the urging force of the urging member.

With such a configuration, after the liquid flows into the pump chamber from the upstream side on the side of the liquid supply source by driving the displacement mechanism, the pump chamber can be permitted to become the pressurized state by stopping the drive of the displacement mechanism and applying the urging force of the urging member to the displacement member. Accordingly, an ejection pressure for ejecting the liquid from the pump chamber can be obtained. Since a force pushing the mixed bubbles is applied, the bubbles can be prevented from remaining in the pump chamber. When the bubbles remain in the pump chamber, the bubbles may be increased by the air or the like flowing from the upstream side. However, by preventing the bubbles from remaining, the bubbles can flow to the downstream side without being increased. Even when the pump chamber is formed of a material having a low gas permeable property, it is difficult to completely prevent the air from permeating. However, by maintaining the pump chamber to be in the pressurized state at time other than the drive of the displacement mechanism, it is possible to prevent the air from permeating through the wall surface and entering the pump chamber. In addition, when the pump chamber is formed of plastic having a gas permeable property, it is possible for the air mixed in the pump chamber to permeate by the pressurizing force and the air is discharged to the outside of the liquid supply passage. That is, since the pump chamber can be kept in the pressurized state by the urging force of the urging member while the liquid supply device is turned off, it is possible to sufficiently guarantee a time period of discharging the air and removal of the bubbles mixed in the pump chamber without the flow of the bubbles flowing to the downstream side.

The liquid supply device according to the aspect of the invention may further include: a first unidirectional valve which is provided on an upstream side of the pump chamber in the liquid supply passage and permits the liquid to pass from the upstream side to the downstream side; a second unidirectional valve which is provided on a downstream side of the pump chamber in the liquid supply passage and permits the liquid to pass from the upstream side to the downstream side; and an opening/closing valve which is provided on a downstream side of the second unidirectional valve in the liquid supply passage and which is normally in a valve-closed state and becomes a valve-opened state when the downstream side is depressurized to a pressure equal to or less than a predetermined pressure by consumption of the ink.

With such a configuration, the first unidirectional valve permitting the liquid to pass from the upstream side to the downstream side is provided on the upstream side of the pump chamber in the liquid supply passage. Therefore, even when the inside of the pump chamber is maintained in the pressurized state, it is possible to prevent the liquid from flowing backward to the upstream side. In addition, the second unidirectional valve permitting the liquid to pass from the upstream side to the downstream side is provided on the downstream side of the pump chamber in the liquid supply passage. Therefore, when the liquid is permitted to flow into the pump chamber from the upstream side by driving the displacement mechanism, it is possible to prevent the liquid from flowing backward from the downstream side. The opening/closing valve which is normally in a valve-closed state and becomes a valve-opened state when the downstream side is depressurized to a pressure equal to or less than a predetermined pressure by consumption of the ink is provided on the downstream side of the second unidirectional valve in the liquid supply passage. Therefore, when the opening/closing valve is in the valve-closed state even in the case of maintaining the inside of the pump chamber in the pressurized state, the liquid is not supplied. When the downstream side is depressurized to a pressure equal to or less than the predetermined pressure by consumption of the ink, the opening/closing valve becomes the valve-opened state. Therefore, it is possible to supply the liquid with the consumption of the ink on the downstream side.

The supply device according to the aspect of the invention may further include: a negative pressure chamber which is provided outside the pump chamber so that the displacement member forms a partition wall along with the pump chamber; and an air opening mechanism which opens the inside of the negative pressure chamber to the air. The displacement mechanism may include a negative pressure generating device generating negative pressure in the negative pressure chamber upon driving the negative pressure generating device. The displacement member may be displaced toward the negative pressure chamber by the negative pressure generated in the negative pressure chamber by driving the negative pressure generating device to allow the liquid to flow into the pump chamber from the upstream side, and the urging force of the urging member may be applied to the displacement member by allowing the air opening mechanism to open the negative pressure chamber to the air upon stopping the drive of the negative pressure generating device so that the pump chamber becomes a pressurized state.

With such a configuration, by generating the negative pressure in the negative pressure chamber by driving the negative pressure generating device, the displacement member can be displaced toward the negative pressure chamber and the liquid can be permitted to flow into the pump chamber from the upstream side. By allowing the air opening mechanism to open the negative pressure chamber to the air upon stopping the drive of the negative pressure generating device, the urging force of the urging member is applied to the displacement member to permit the pump chamber to become the pressurized state. Here, when the volume of the pump chamber is decreased by allowing the actuator, for example, to pressurize the urging member, the pump chamber cannot be maintained in the pressurized state upon stopping the actuator. When the pump chamber is permitted to be in the pressurized state by the pressurizing force of the pressurized air, the pressurizing force may become weak due to the leakage of the pressurized air after the drive of the pressurizing device stops. However, by urging the displacement member by the urging member, it is possible to maintain the pressurized state without making the pressurizing force weak. That is, by stopping the drive of the negative pressure generating device and allowing the air opening mechanism to open the negative pressure chamber to the air after the negative pressure generating device is driven to generate the negative pressure in the negative pressure chamber, it is possible to maintain the pump chamber in the pressurized state.

In the supply device according to the aspect of the invention, a first forming member for forming the liquid supply passage and the pump chamber and a second forming member for forming the negative pressure chamber may be laminated with the displacement member interposed therebetween.

With such a configuration, since a lamination structure is formed such that the first forming member for forming the liquid supply passage and the pump chamber and the second forming member for forming the negative pressure chamber interpose the displacement member, it is possible to make the liquid supply device compact and thus save a space. Moreover, the assembling work is simplified.

In the supply device according to the aspect of the invention, the urging member may be a spring member provided outside the pump chamber.

With such a configuration, since the spring member as the urging member is provided outside the pump chamber, for example, in the negative pressure chamber, it is possible to urge the displacement member without the contact with the liquid. Accordingly, it is possible to prevent an unnecessary chemical change from occurring due to the spring member coming into contact with the liquid. When the spring member is present in the pump chamber, bubbles may be trapped in the spring member and thus it is difficult to discharge the bubbles even by cleaning. However, since the spring member is provided outside the pump chamber, it is possible to prevent the bubbles from remaining in the pump chamber.

According to another aspect of the invention, there is provided a liquid ejecting apparatus including: a liquid ejecting unit which ejects a liquid; and the above-described liquid supply device which supplies the liquid to the liquid ejecting unit.

With such a configuration, it is possible to obtain the same operational advantages as those of the liquid supply device.

According to still another aspect of the invention, there is provided a liquid supplying method in a liquid supply device including a pump which is provided with a pump chamber in a liquid supply passage supplying a liquid from an upstream side on which the liquid is supplied from a liquid supply source to a downstream side on which the liquid is consumed, the liquid supplying method including: displacing a displacement member as a part of a wall surface of the pump chamber, which is displaceable to increase or decrease the volume of the pump chamber and urged in a direction decreasing the volume of the pump chamber by an urging member, in a direction increasing the volume of the pump chamber against an urging force of the urging member by driving a displacement mechanism; and pressurizing the pump chamber by applying the urging force of the urging member to the displacement member upon stopping the drive of the displacement mechanism.

With such a configuration, it is possible to obtain the same operational advantages as those of the liquid supply device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer (hereinafter, referred to as "a printer") which is an example of a liquid ejecting apparatus according to an embodiment of the invention will be described with reference to FIGS. 1 to 20.

Figure 1:
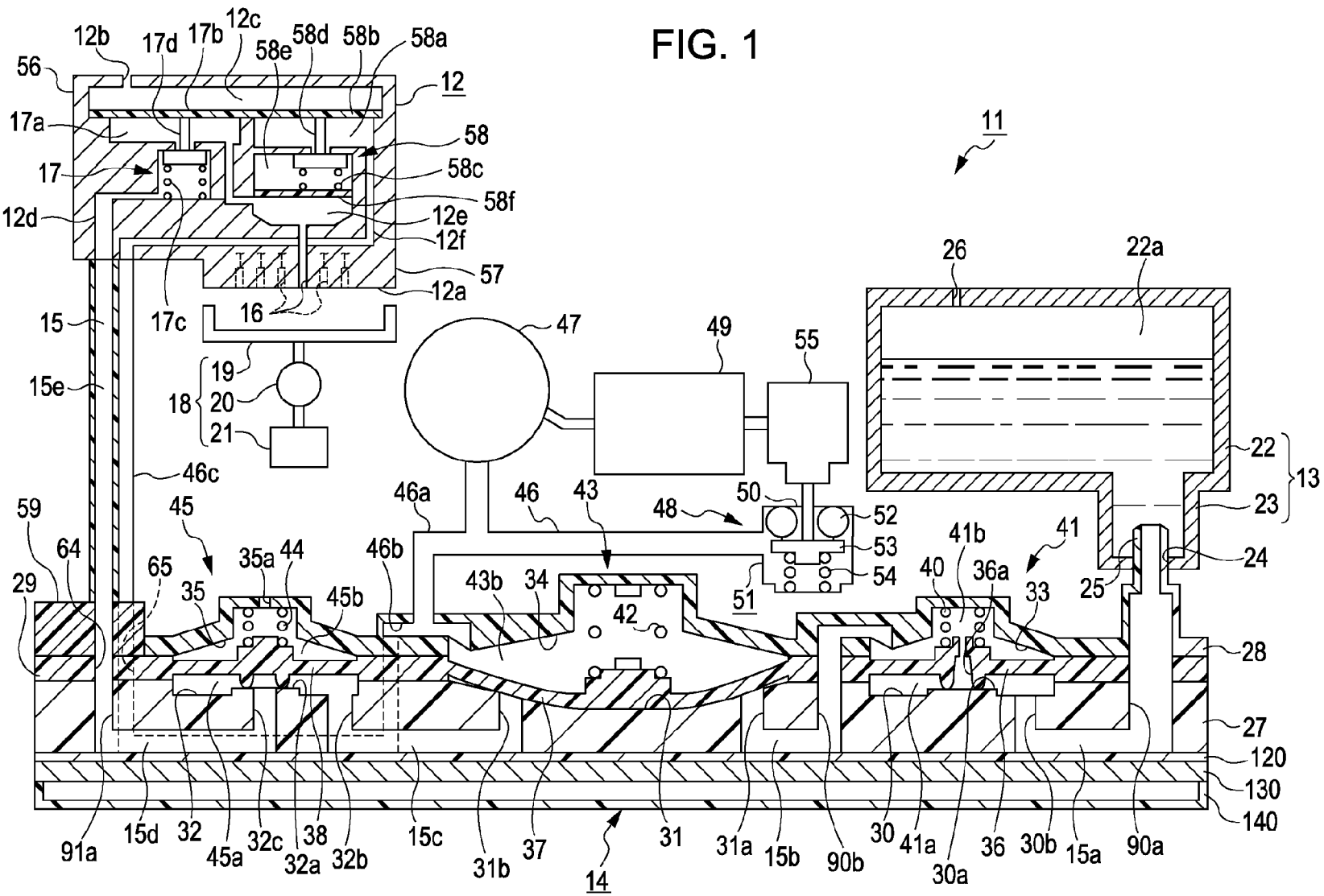
FIG. 1 is a schematic sectional view illustrating an ink jet printer according to an embodiment.

As shown in FIG. 1, a printer 11 according to this embodiment includes a printing head unit 12 as a liquid ejecting unit which ejects ink (liquid) onto a target (for example, a print medium such as a sheet) (not shown) and an ink supply device 14 (a liquid supply unit) which supplies the ink stored in an ink cartridge 13 as a liquid storing member (liquid supply source) to the printing head unit 12. When the upstream end of the ink supply device is connected to the ink cartridge 13 and the downstream end of the ink supply device is connected to the printing head unit 12, a part of an ink passage 15 supplying the ink from an upstream side, which is the ink cartridge 13, to a downstream side, which is the printing head unit 12, is formed in the ink supply device 14.

The printer 11 according to this embodiment is an ink jet type serial printer or line printer and a so-called off-carriage type printer in which the ink cartridge 13 is mounted on a printer main body. As described in FIG. 1, the printing head unit 12 connected to the ink supply device 14 through an ink supply tube 15*e* includes a head unit body 56 and a printing head 57. In the serial printer, for example, the head unit body 56 is formed by a carriage which reciprocates in a main scanning direction (right and left directions in FIG. 1), while being guided by a guiding mechanism by the power of an electric motor (carriage motor) (all of which are not shown). On the other hand, in the line printer, the head unit body 56 is fixed so as to extend in a width direction perpendicular to a sheet transporting direction, and the printing head 57 is configured such that the nozzles for each color are arranged in the whole of the maximum sheet width at a predetermined nozzle pitch. Of course, in the serial printer, the ink supply device 14 may be used in a so-called on-carriage type printer in which an ink cartridge is mounted on a carriage.

The printer 11 according to this embodiment is provided with plural the ink supply devices 14 to correspond to the number (kinds) of ink colors to be used for the printer 11. In this case, since the ink supply devices have the same configuration, one ink supply device 14 supplying one kind of ink, the printing head unit 12, and one ink cartridge 13 are shown in FIG. 1. Hereinafter, a case in which tone ink supply device 14 shown in FIG. 1 supplies the ink from the ink cartridge 13 to the printing head unit 12 will be described as an example. In the ink supply device 14 shown in FIG. 1, the cross-section of passages or valves is schematically shown to explain a principle of an ink supply mechanism. A preferable shape including the layout of the passages or the valves is described below with reference to separate drawings.

As shown in FIG. 1, in the printing head 57, plural nozzles 16 (in this embodiment, six nozzles) corresponding to the number of ink supply devices 14 are opened on a nozzle forming surface 12*a* which faces a platen (not shown). The ink supplied from each of the ink supply devices 14 to an ink passage 12*d* formed in the printing head unit 12 through the ink passage 15 is supplied to the nozzles 16 via a valve unit 17 and a defoaming unit 58 formed in the ink passage 12*d*. That is, a pressure chamber 17*a* temporarily storing the ink flowing from the ink passage 15 is formed in the valve unit 17 to communicate with the nozzles 16. Upon ejecting the ink from the nozzles 16, an amount of ink corresponding to an amount of ink consumed upon ejecting the ink flows from the ink passage 15 to the pressure chamber 17*a* appropriately in accordance with an opening or closing operation of a passage valve 17*d*. The configuration of the valve unit 17 and the defoaming unit 58 is described. The six nozzles 16 form nozzle rows such that the plural nozzles are disposed at a uniform nozzle pitch in a direction perpendicular to the surface of FIG. 1. A direction of the nozzle row (the direction perpendicular to the surface of FIG. 1) is equal to the sheet transporting direction in the serial printer and a sheet width direction in the line printer.

The printer 11 is provided with a maintenance unit 18 which performs a cleaning operation on the printing head 57 so as to solve clogging or the like of the nozzles 16 of the printing head 57. The maintenance unit 18 includes a cap 19 which comes in contact with the nozzle forming surface 12*a* of the printing head 57 to surround the nozzles 16, a sucking pump 20 which is driven upon sucking the ink from the cap 19, and a waste liquid tank 21 to which the ink sucked from the cap 19 with the drive of the sucking pump 20 is discharged as waste ink. In addition, upon performing the cleaning operation, the thickened ink or the ink mixed with bubbles is discharged from the printing head 57 to the waste liquid tank 21 by driving the sucking pump 20 in the state where the cap 19 is moved from the state shown in FIG. 1 and comes in contact with the nozzle forming surface 12*a* of the printing head 57 and by generating a negative pressure in the inner space of the cap 19. In addition, the maintenance unit 18 is disposed at a location corresponding to a home position in which the printing head unit 12 is located in non-printing in the serial printer and disposed directly below the printing head 57 in the line printer.

On the other hand, the ink cartridge 13 includes a substantial box-like case 22 serving as an ink chamber 22*a* storing ink therein. A pipe unit 23 communicating with the inside of the ink chamber 22*a* is formed downward on the lower wall of the case 22. An ink supply port 24 through which the ink can lead out is formed on the front end of the pipe unit 23. When the ink cartridge 13 is connected to the ink supply device 14, a supply needle 25 protruding from the ink supply device 14 to form the upstream end of the ink passage 15 is inserted into the ink supply port 24, an air communication hole 26 allowing the inside of the ink chamber 22*a* storing the ink to communicate to the air is formed through the upper wall of the case 22 so that the air pressure is exerted to the liquid surface of the ink stored in the ink chamber 22*a*.

Next, the configuration of the ink supply device 14 will be described in detail.

As shown in FIG. 1, the ink supply device 14 includes a first passage forming member 27 as a first forming member made of a plastic material having a gas permeable property and serving as a base body, a second passage forming member 28 as a second forming member made of the same plastic material and laminated on the first passage forming member 27 to be assembled, and a flexible member 29 as a displacement member formed of a rubber plate or the like and interposed between both the passage forming members 27 and 28 upon the assembly. A film 120 is adhered onto the surface (rear surface) on the first passage forming member 27 opposite to the flexible member 29. Moreover, a protective plate 130 and a receiving plate 140 are laminated on the lower surface of the film 120. Here, concave sections 30, 31, and 32 having a circular shape in a plan view are formed at plural positions (in this embodiment, three positions) on the upper surface of the first passage forming member 27. That is, the concave sections 30 to 32 are formed in parallel in the order of the concave sections 30, 31, and 32 from the right side to the left side in FIG. 1.

On the other hand, concave sections 33, 34, and 35 having a circular shape in a plan view and vertically facing the concave sections 30, 31, and 32 formed on the surface of the first passage forming member 27 are formed at plural positions (in this embodiment, three positions) on the lower surface of the second passage forming member 28 laminated on the first passage forming member 27. That is, the concave sections 33 to 35 are formed parallel in order of the concave sections 33, 34, and 35 from the right side to the left side in FIG. 1. An air communication hole 35*a* communicating to the air is on the bottom of the concave section 35 formed at the most left side in the second passage forming member 28 in FIG. 1.

The flexible member 29 is interposed between the first passage forming member 27 and the second passage forming member 28 such that plural locations (three locations in this embodiment) of the flexible member 29 are vertically separated between the concave sections 30 to 32 of the first passage forming member 27 and the concave sections 33 to 35 of the second passage forming member 28. As a consequence, a portion of the flexible member 29 interposed between the concave section 30 of the first passage forming member 27 and the concave section 33 of the second passage forming member 28 functions as a sucking valve body 36 which can elastically displace between the concave sections 30 and 33.

Likewise, a portion of the flexible member 29 interposed between the concave section 31 of the first passage forming member 27 and the concave section 34 of the second passage forming member 28 functions as a diaphragm 37 which can elastically displace between the concave sections 31 and 34. Likewise, a portion of the flexible member 29 interposed between the concave section 32 of the first passage forming member 27 and the concave section 35 of the second passage forming member 28 functions as an ejecting valve body 38 which can elastically displace between the concave sections 32 and 35.

As shown in FIG. 1, a first passage 15*a* permitting the ink supply needle 25 protruding from the upper surface of the second passage forming member 28 to communicate with the concave section 30 of the first passage forming member 27 is formed in the first passage forming member 27 and the second passage forming member 28 so as to form a part of the ink passage 15 of the ink supply device 14. Likewise, a second passage 15*b* permitting the concave section 33 of the second passage forming member 28 to communicate with the concave section 31 of the first passage forming member 27 is formed in the first passage forming member 27, the second passage forming member 28, and the flexible member 29 so as to form a part of the ink passage 15 of the ink supply device 14. Likewise, a third passage 15*c* permitting the concave sections 31 and 32 of the first passage forming member 27 to communicate with each other is formed in the first passage forming member 27 so as to form a part of the ink passage 15 of the ink supply device 14.

Likewise, a fourth passage 15*d* permitting the concave section 32 of the first passage forming member 27 to communicate with the upper surface of the second passage forming member 28 is formed in the first passage forming member 27, the second passage forming member 28, and the flexible member 29 so as to form a part of the ink passage 15 of the ink supply device 14. An ink display port 64 which is a passage opening end of the fourth passage 15*d* opened to the upper surface of the flexible member 29 is connected to one end (upstream end) of the ink supply tube 15*e*, which forms a part of the ink passage 15, through a pipe connection tool 59 attached to the end of the ink supply device 14. In addition, the other end (downstream end) of the ink supply tube 15*e* is connected to the valve unit 17 on the side of the printing head unit 12. In this embodiment, the first passage 15*a* to the fourth passage 15*d* form a liquid supply passage.

As shown in FIG. 1, the passages 15*a*, 15*b*, 15*c*, and 15*d* are in a passage passing through the rear surface of the first passage forming member 27. Therefore, through-holes 90*a* and 30*b* forming the first passage 15*a* and a groove permitting the through-holes 90*a* and 30*b* to communicate with each other, through-holes 90*b* and 31*a* forming the second passage 15*b* and a groove permitting the through-holes 90*b* and 31*a* to communicate with each other, through-holes 31*b* and 32*b* forming the third passage 15*c* and a groove permitting the through-holes 31*b* and 32*b* to each other, and through-holes 32*c* and 91*a* forming the fourth passage 15*d* and a groove permitting the through-holes 32*c* and 91*a* to communicate with each other are formed in the first passage forming member 27. In addition, parts of the passages 15*a*, 15*b*, 15*c*, and 15*d* are surrounded by a film 120 welded on the rear surface of the passage forming member 27 and the respective grooves, respectively.

As shown in FIG. 1, a portion which serves as the sucking valve body 36 of the flexible member 29 of the ink supply device 14 is provided with a through-hole 36*a* in the middle thereof and urged toward the inner bottom surface of the lower-side concave section 30 by an urging force of a coil spring 40 disposed in the upper-side concave section 33. In this embodiment, the concave sections 30 and 33, the sucking valve body 36, and the coil spring 40 constitute a sucking valve 41 as a first unidirectional valve provided in the ink passage 15 so as to open and close the ink passage 15. The sucking valve 41 includes a valve chamber 41*a* communicating with an opening on the downstream end of the first passage 15*a* and a valve chamber 41*b* communicating with an opening (an ink discharging port) on the upstream end of the second passage 15*b*. The valve chamber 41*a* is formed as a spatial area with a ring shape surrounded by the concave section 30 and the sucking valve body 36 in a valve closed state where the middle of the sucking valve body 36 comes in contact with a valve seat 30*a* in the middle of the bottom surface of the concave section 30. With such a configuration, during the openness and closeness of the sucking valve 41, the ink pressure of the valve chambers 41*a* and 41*b* is applied to the sucking valve body 36 with an area sufficiently broader than the opening area of the passages 15*a* and 15*b*, and the sucking valve 41 can be opened and closed with good sensitivity even by a relatively small differential pressure between the valve chambers 41*a* and 41*b*. That is, the sucking valve 41 can be opened and closed with good sensitivity, compared to a case of using the sucking valve 41 having a structure in which the coil spring 40 urges the sucking valve body 36 in a valve closing direction.

Likewise, a portion which becomes a diaphragm 37 of the flexible member 29 of the ink supply device 14 is urged toward the inner bottom surface of the lower-side concave section 31 by the urging force of a coil spring 42 (an urging member) disposed in the upper-side concave section 34. In this embodiment, the concave sections 31 and 34, the diaphragm 37, and the coil spring 42 constitute a pulsation type pump 43. A volume variable spatial area surrounded by the diaphragm 37 and the lower-side concave section 31 functions as a pump chamber 43*a* in the pump 43.

That is, the diaphragm 37 formed of the flexible member 29 forms a part of the wall surface of the pump chamber 43*a* and is displaceable to increase or decrease the volume of the pump chamber 43*a*. In addition, the coil spring 42 as a spring member provided outside the pump chamber 43*a* urges the diaphragm 37 in a direction decreasing the volume of the pump chamber 43*a*.

Likewise, a portion which becomes the ejecting valve body 38 of the flexible member 29 of the ink supply device 14 is urged toward the inner bottom surface of the lower-side concave section 32 by the urging force of a coil spring 44 (an urging member) disposed in the upper-side concave section 35. In this embodiment, the concave sections 32 and 35, the ejecting valve body 38, and the coil spring 44 constitute an ejecting valve 45 (an ejecting check valve) as a second unidirectional valve provided in the ink passage 15 on the more downstream side than the pump 43 so as to open and close the ink passage 15. The ejecting valve 45 includes a valve chamber 45*a* (an ink chamber) communicating with an opening (an ink inflow port) on the downstream end of the third passage 15*c* and a valve chamber 45*b* (an air chamber) opened to the air through an air communication hole 35*a*. The valve chamber 45*a* is formed as a spatial area with a ring shape surrounded by the concave section 32 and the ejecting valve body 38 in a valve closed state where the middle of the ejecting valve body 38 comes in contact with a valve seat 32*a* in the middle of the bottom surface of the concave section 32. With such a configuration, during the openness and closeness of the ejecting valve 45, the ink pressure of the valve chamber 45*a* is applied to the ejecting valve body 38 with an area sufficiently broader than the opening area of the third passage 15*c*, and the ejecting valve 45 can be opened and closed with good sensitivity even by a relatively small variation in pressure between the valve chamber 45*a*. That is, the ejecting valve 45 can be opened and closed with good sensitivity in comparison to using the ejecting valve 45 having a structure in which the coil spring 44 urges the ejecting valve body 38 in the valve closing direction. In this embodiment, the second passage 15*b* forms a part of the liquid supply passage permitting the first unidirectional valve to communicate with a supply pump, and the third passage 15*c* forms a part of the liquid supply passage permitting the supply pump to communicate with the second unidirectional valve.

As shown in FIG. 1, a negative pressure generating device 47 constituted by the sucking pump or the like and an air opening mechanism 48 are connected to the concave section 34 of the second passage forming member 28 via an air passage 46 having a shape diverged in both directions. The negative pressure generating device 47 is driven by a driving force, which is transferred via a one-way clutch (not shown) when a driving motor 49 capable of forward and backward rotation is driven to rotate forward, to generate negative pressure. Likewise, the negative pressure generating device can also generate negative pressure in the concave section 34 of the second passage forming member 28 connected via the air passage 46. In this embodiment, the air passage 46, the negative pressure generating device 47, and the driving motor 49 form a displacement mechanism.

The volume variable spatial area surrounded by the concave section 34 of the second passage forming member 28 and the diaphragm 37 is configured to function as a negative pressure chamber 43*b* which becomes a negative pressure state with the drive of the negative pressure generating device 47. That is, the pumps 43 have a lamination structure in which the first passage forming member 27 forming the first passage 15*a* to the fourth passage 15*d* and the pump chambers 43*a* and the second passage forming member 28 forming the negative pressure chambers 43*b* interpose the flexible member 29. The negative pressure chamber 43*b* is provided outside the pump chamber 43*a* so that the diaphragm 37 forms a partition wall with the pump chamber 43*a*.

On the other hand, the air opening mechanism 48 has a configuration in which an air opening valve 53 formed by adding a sealing member 52 to the side of an air opening hole 50 in a box 51 provided with the air opening hole 50 is accommodated and the air opening valve 53 typically urges the air opening hole 50 by the urging force of the coil spring 54 in the valve closing direction in which the air opening hole 50 is sealed. In addition, the air opening mechanism 48 is configured such that a cam mechanism 55 operating on the basis of the driving force transferred via the one-way clutch (not shown) operates when the driving motor 49 is driven to rotate backward and the air opening valve 53 is displaced against the urging force of the coil spring 54 in a valve opening direction by the operation of the cam mechanism 55. That is, the air opening mechanism 48 opens the inside of the negative pressure chamber 43*b* to the air to release a negative pressure state by allowing the air opening valve 53 to perform a valve opening operation when the negative pressure chamber 43*b* connected via the air passage 46 becomes the negative pressure state.

One negative pressure generating device 47, one air opening mechanism 48, and one driving motor 49 driving the negative pressure generating device and the air opening mechanism are provided and shared by the plural ink supply devices 14. That is, an air passage pipe 46*a* forming the air passage 46 which connects between the negative pressure generating device 47, the air opening mechanism 48, and each ink supply device 14 is connected to an air passage 46*b* formed in each ink supply device 14. The air passage 46*b* is diverged in the midway thereof and the front end of the diverged passage is connected to the negative pressure chamber 43*b* of the pump 43 of each ink supply device 14. With such a configuration, since the ink supply devices 14 can be driven just by providing one negative pressure generating device 47, one air opening mechanism 48, and one driving motor 49 in the plural ink supply devices 14, it is possible to reduce the size of the printer 11. The air passage 46*b* connected to the pressure chamber 43*b* of each pump 43 is opened to the upper surface of the flexible member 29 via the rear surface of the first passage forming member 27 and forms a negative pressure lead-out port 65. The negative pressure lead-out port 65 is connected to one end (the upstream end) of an air supply tube 46*c* through the pipe connection tool 59. In addition, the other end (the downstream end) of the air supply tube 46*c* is connected to the printing head unit 12 and negative pressure can be introduced to the defoaming unit 58.

Here, the configurations and functions of the valve unit 17 and the defoaming unit 58 provided within the printing head unit 12 will be described. As shown in FIG. 1, an air chamber 12*c* communicating to the air via the air communication hole 12*b* is provided within the printing head unit 12. The valve unit 17 includes the pressure chamber 17*a* which temporarily stores the ink flowing to the ink passage 12*d* formed in the printing head unit 12, a partition wall 17*b* partitioning the pressure chamber 17*a* and the air chamber 12*c*, and a passage valve 17*d* which is urged in the valve closing direction by a spring 17*c* to come in contact with the partition wall 17*b*. The partition wall 17*b* is formed of a film (or a sheet) made of a flexible material (for example, synthetic resin or rubber), and a metal piece (for example, a metal piece having a pectinate shape, for example) (not shown) having a portion displaceable together with, for example, a film is disposed at the contact position of the passage valve 17*d*. In addition, an ink storing chamber 12*e* which temporarily stores ink is formed in the ink passage 12*d* formed from the pressure chamber 17*a* to the nozzles 16.

When the ink from the nozzles 16 is ejected and consumed, the actual pressure of the pressure chamber 17*a* is depressurized by a decrease in the ink and the partition wall 17*b* is bent and deformed toward the pressure chamber 17*a* on the basis of a differential pressure between the depressurized pressure chamber 17*a* and the air chamber 12*c*, so that the passage valve 17*d* is moved to a valve opened position against the urging force of the spring 17*c* and the ink flows to the pressure chamber 17*a*. When the ink flows into the pressure chamber 17*a* and the actual pressure of the pressure chamber is increased, the passage valve 17*d* is again moved to a valve closed position since the actual pressure exceeds the urging force of the spring 17*c*.

In this way, when the passage valve 17*d* of the valve unit 17 opens and closes the passage in accordance with the consumption of the ink, the ink is configured to appropriately flow from the ink supply tube 15*e* to the printing head unit 12. That is, the passage plate 17*d* is normally in the valve-closed state and becomes the valve-opened state when the downstream side is depressurized to a pressure equal to or less than a predetermined pressure by the consumption of the ink.

The defoaming unit 58 includes a depressurizing chamber 58*a* communicating with the air supply tube 46*c* via the negative pressure passage 12*f* formed in the printing head unit 12, a partition wall 58*b* partitioning the depressurizing chamber 58*a* and the air chamber 12*c*, a passage valve 58*d* urged by the spring 58*c* to come in contact with the partition wall 58*b*, and a negative pressure chamber 58*e* communicating with the depressurizing chamber 58*a* upon valve openness of the passage valve 58*d*. The two partition walls 17*b* and 58*b* are formed of a common film (or a sheet) and a metal piece (not shown) having a piece displaceable together with the contact position of the passage valve 58*d* is disposed in the partition wall 58*b*.

The negative pressure chamber 58*e* and the ink storing chamber 12*e* are partitioned through a partition wall 58*f* formed of a synthetic resin material having a gas permeable property. When a negative pressure is introduced to the depressurizing chamber 58*a* via the air supply tube 46*c* and the negative pressure passage 12*f* upon the sucking drive of the pump 43, the partition wall 58*b* is bent and deformed toward the depressurizing chamber 58*a* on the basis of the differential pressure between the depressurizing chamber 58*a* and the air chamber 12*c* and the negative pressure of the depressurizing chamber 58*a* is introduced to the negative pressure chamber 58*e* by moving the passage valve 58*d* to the valve opened position against the urging force of the spring 58*c*. On the other hand, the depressurizing chamber 58*a* is opened to the air through the air supply tube 46*c* and the negative pressure passage 12*f* upon the ejecting drive of the pump 43. At this time, however, since the passage valve 58*d* is maintained at the valve closed position by the urging force of the spring 58*c*, the negative pressure chamber 58*e* maintains the negative pressure state. That is, after the sucking drive of the pump 43 is performed at least one time after the activation of the printer 11, the negative pressure chamber 58*e* maintains a negative pressure state to some extent or more, and bubbles or dissolved air in the ink stored in the ink storing chamber 12*e* permeate through the partition wall 58*f* to be collected to the side of the negative pressure chamber 58*e*. In this way, the defoaming unit 58 defoams the ink.

Figure 2A:
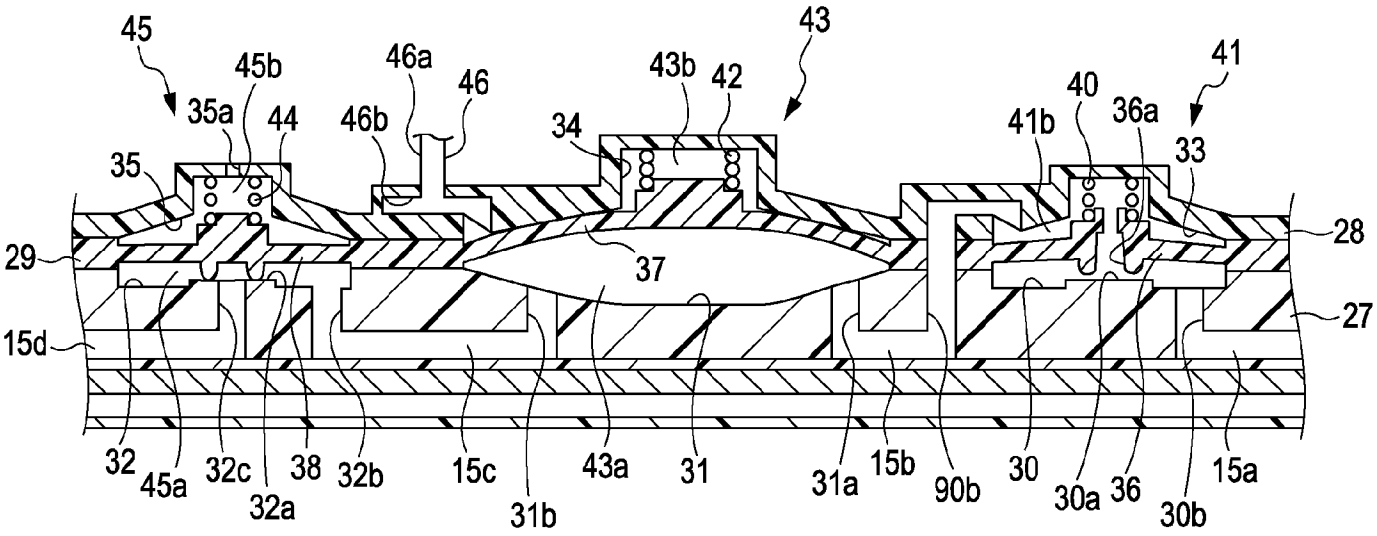
FIG. 2A is a schematic sectional view illustrating an ink supply device upon suction drive and FIG. 2B is a schematic sectional view illustrating the ink supply device upon ejection drive.
Figure 2B:
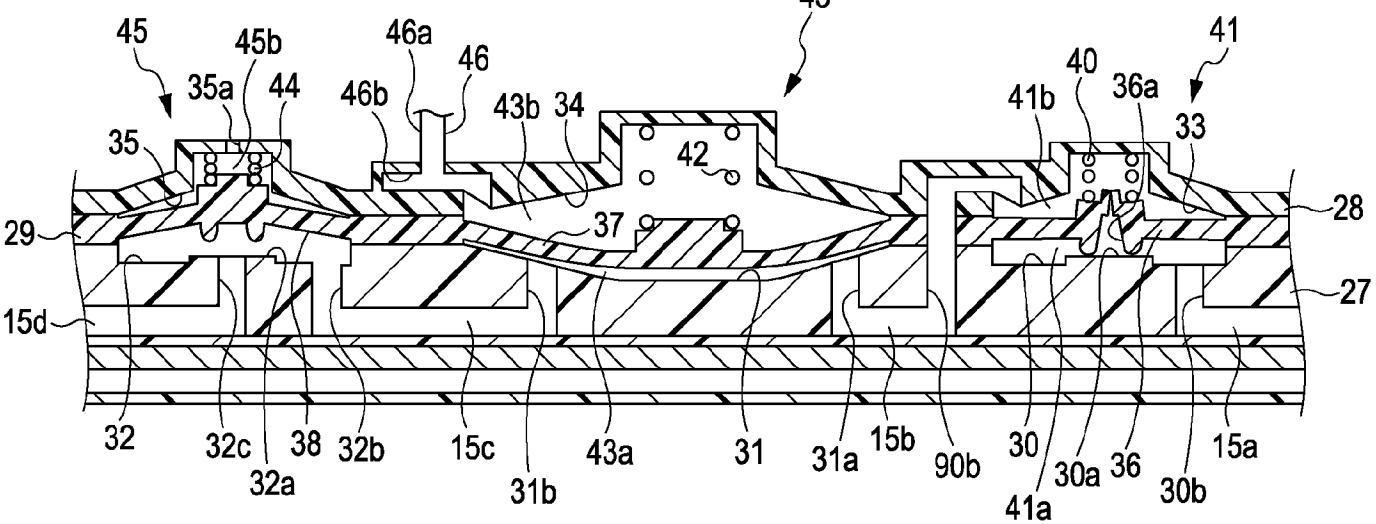

Next, the operation of the printer 11 having the above-described configuration will be described particularly focusing the operation of the ink supply device 14. FIG. 2A is a diagram illustrating the cross-section of the ink supply device upon the sucking drive and FIG. 2B is a diagram illustrating the cross-section of the ink supply device upon the ejecting drive.

First, it is assumed that the state shown in FIG. 1 shows the state immediately after an old ink cartridge is replaced by a new ink cartridge, and the sucking valve body 36 of the sucking valve 41, the diaphragm 37 of the pump 43, and the ejecting valve body 38 of the ejecting valve 45 are pressed down and attached onto the inner bottom surface of the lower-side concave sections 30, 31, and 32 by the urging forces of the coil springs 40, 42, and 44, respectively. In addition, it is assumed that the air opening mechanism 48 is in the valve closed state where the air opening valve 53 seals the air opening hole 50.

When the ink supply device 14 supplies the ink from the ink cartridge 13 to the printing head unit 12 in the state shown in FIG. 1, the driving motor 49 is first driven to rotate forward to drive the pump 43. Then, the negative pressure generating device 47 generates the negative pressure and the negative pressure chamber 43*b* of the ink supply device 14 connected to the negative pressure generating device 47 via the air passage 46 becomes the negative pressure state. Accordingly, the diaphragm 37 of the pump 43 is elastically deformed (displaced) toward the negative pressure chamber 43*b* against the urging force of the coil spring 42 to decrease the volume of the negative pressure chamber 43*b* (see FIG. 2A). Then, the volume of the pump chamber 43*a* partitioned with the negative pressure chamber 43*b* through the diaphragm 37 is conversely increased with the decrease in the volume of the negative pressure chamber 43*b*.

That is, upon driving the negative pressure generating device 47, the pump 43 displaces the diaphragm 37 in a direction increasing the volume of the pump chamber 43*a* to perform the sucking drive. Specifically, the diaphragm 37 is displaced from a bottom dead point shown in FIG. 1 to a top dead point shown in FIG. 2A. Accordingly, the pump chamber 43*a* becomes a negative pressure state, the negative pressure is applied to the upper-side valve chamber 41*b* of the sucking valve 41 through the second passage 15*b*, and the sucking valve body 36 is elastically deformed (displace) toward the upper side (that is, in the valve opening direction) against the urging force of the coil spring 40 on the basis of the pressure difference with the ink pressure of the lower-side valve chamber 41*a*. As a consequence, the first passage 15*a* and the second passage 15*b* becomes a communication state one another through the through-hole 36*a* of the sucking valve body 36, and the ink is sucked from the ink cartridge 13 to the pump chamber 43*a* via the first passage 15*a*, the valve chamber 41*a*, the through-hole 36*a*, the valve chamber 41*b*, and the second passage 15*b*.

On the other hand, upon the sucking drive of the pump 43, the negative pressure of the pump chamber 43*a* is also applied to the more downstream side of the ink passage 15 than the pump chamber 43*a*, that is, the third passage 15*c* through the third passage 15*c*. However, the lower-side valve chamber 45*a* of the ejecting valve 45 communicating with the downstream side of the third passage 15*c* is configured so as not to become the valve opened state, as long as the ejecting valve body 38 is urged in the valve closing direction by the coil spring 44 and an ink ejection pressure of a predetermined positive pressure (for example, a pressure of 13 kPa or more) is not applied from the upstream side of the third passage 15*c* to the ejecting valve body 38 by the ejecting drive of the pump 43 in the valve closed state. Accordingly, in this case, the ejecting valve body 38 of the ejecting valve 45 maintains the valve closed state, since the negative pressure is applied.

Next, the driving motor 49 is driven to rotate backward in the state shown in FIG. 2A. Then, the air opening valve 53 performs the valve opening operation against the urging force of the coil spring 54 by the operation of the cam mechanism 55 of the air opening mechanism 48 and opens the negative pressure chamber 43*b*, which has been in the negative pressure state, to the air. Accordingly, the diaphragm 37 of the pump 43 is elastically deformed (displaced) toward the lower side (that is, the inner bottom surface of the pump chamber 43*a*) and the volume of the negative pressure chamber 43*b* is increased by the urging force of the coil spring 42 (see FIG. 2B). On the contrary, the volume of the pump chamber 43*a* of the pump 43 partitioned with the negative pressure chamber 43*b* through the diaphragm 37 decreases with the increase in the volume of the negative pressure chamber 43*b*.

That is, since the urging force of the coil spring 42 is applied to the diaphragm 37 by allowing the air opening mechanism 48 to open the negative pressure chamber 43*b* to the air upon stopping the drive of the negative pressure generating device 47, the pump 43 displaces the diaphragm 37 in a direction decreasing the volume of the pump chamber 43*a* to perform the ejecting drive. Specifically, as shown in FIG. 2B, the diaphragm 37 is displaced from the top dead point to the bottom dead point, and the ink which has been sucked into the pump chamber 43*a* is pressurized at a predetermined pressure (for example, about a pressure of 30 kPa). Accordingly, the ink in the pump chamber 43*a* is ejected, the ejection pressure is applied to the upper-side valve chamber 41*b* of the sucking valve 41 via the second passage 15*b* on the upstream side of the pump chamber 43*a*, and the ejection pressure elastically deforms (displaces) the sucking valve body 36 toward the lower side (that is, the valve closing direction) in cooperation with the urging force of the coil spring 40. As a consequence, the first passage 15*a* and the second passage 15*b* become a non-communication state by the valve closing operation of the sucking valve body 36, the suction of the ink from the ink cartridge 13 to the pump chamber 43*a* via the sucking valve 41 stops, and the ink ejected from the pump chamber 43*a* with the ejecting drive of the pump 43 is regulated so as not to flow backward to the ink cartridge 13 via the sucking valve 41.

On the other hand, upon the ejecting drive of the pump 43, the pressure (for example, about a pressure of 30 kPa) of the ink ejected from the pump chamber 43*a* is also applied to the downstream side of the ink passage 15 via the third passage 15*c*. Accordingly, the ejecting pressure of the pump 43 permits the ejecting valve body 38 in the valve closed state to perform the valve opening operation, so that the third passage 15*c* and the fourth passage 15*d* communicate with each other through the lower-side valve chamber 45*a* in the ejecting valve 45. As a consequence, the pressurized ink from the pump chamber 43*a* is supplied to the valve unit 17 via the third passage 15*c*, the valve chamber 45*a*, the fourth passage 15*d*, and the ink supply tube 15*e*. In addition, the urging force of the coil spring 44 in the ejecting valve 45 is set to about 13 kPa, for example, so that the ejecting valve body 38 is elastically deformed toward the upper side by the ejection pressure of the ink, when the ink flows to the valve chamber 45*a* of the ejecting valve 45 upon the ejecting drive of the pump 43.

Thereafter, the ejection pressure of the ink pressurized by the diaphragm 37 and ejected from the pump chamber 43*a* remains in balance in the respective passage areas (which include the pump chamber 43*a* and the valve chamber 45*a* of the ejecting valve 45) on the downstream side including the valve chamber 41*b* of the sucking valve 41 in the ink passage 15. Thereafter, when the ink is ejected from the printing head 57 to a target (not shown), an amount of the ink corresponding to the amount of ink consumed upon the ejection of the ink is supplied from the ink passage 15 to the printing head unit 12 upon the valve openness of the valve unit 17. Accordingly, as the ink is consumed in the downstream side (the printing head unit 12), the amount of ink corresponding to the amount of ink consumed is supplied in the pressurized state to the printing head unit 12 (on the downstream side) on the basis of the pressurizing force of the diaphragm 37 urged in a direction decreasing the volume of the pump chamber 43*a* by the urging force of the coil spring 42.

As a consequence, the volume of the pump chamber 43*a* and the volume of the valve chamber 45*a* of the ejecting valve 45 gradually decrease. Finally, the diaphragm 37 is displaced up to the vicinity of the bottom dead point and the ejecting valve body 38 is displaced up to the vicinity of the valve closed position at which the fourth passage 15*d* is closed. In this embodiment, the diaphragm 37 is pressurized at this time point and the ejection pressure of the ink ejected from the pump chamber 43*a* becomes about 13 kPa.

Then, the driving motor 49 is again driven to rotate forward, the air opening valve 53 is displaced in the air opening mechanism 48 to the valve closed position at which the air opening hole 50 is closed. In addition, the negative pressure generating device 47 generates the negative pressure, so that the negative pressure chamber 43*b* becomes the negative pressure state and the diaphragm 37 is elastically deformed (displaced) toward the negative pressure chamber 43*b* against the urging force of the coil spring 42. That is, the pump 43 again starts the sucking drive. As a consequence, since the diaphragm 37 is displaced to the top dead point to increase the volume of the pump chamber 43*a* and the pump chamber 43*a* becomes the negative pressure state, the sucking valve body 36 is elastically deformed (displaced) in the valve opening direction. Accordingly, the first passage 15*a* and the second passage 15*b* becomes the communication state through the through-hole 36*a* of the sucking valve body 36, and the ink is sucked from the ink cartridge 13 to the pump chamber 43*a*. Thereafter, the ejecting drive of the pump 43 is performed and the pressurized ink is supplied from the pump chamber 43*a* to the printing head unit 12 via the ink passage area on the downstream side.

In this embodiment, when the printing ends, the driving motor 49 is driven to rotate forward to perform the sucking drive of the pump 43 and then the driving motor 49 is driven to rotate backward to allow the negative pressure chamber 43*b* to open to the air. That is, in order to prevent the bubbles from remaining in the pump chamber 43*a*, the pump chamber 43*a* is maintained in the pressurized state by allowing the urging force of the coil spring 42 to apply to the diaphragm 37, even while the printer 11 is turned off.

Next, an example of an ink supply system in which the plural ink supply devices 14 having the above-described configuration are made into one unit will be described with reference to FIGS. 3 to 20.

Figure 3:
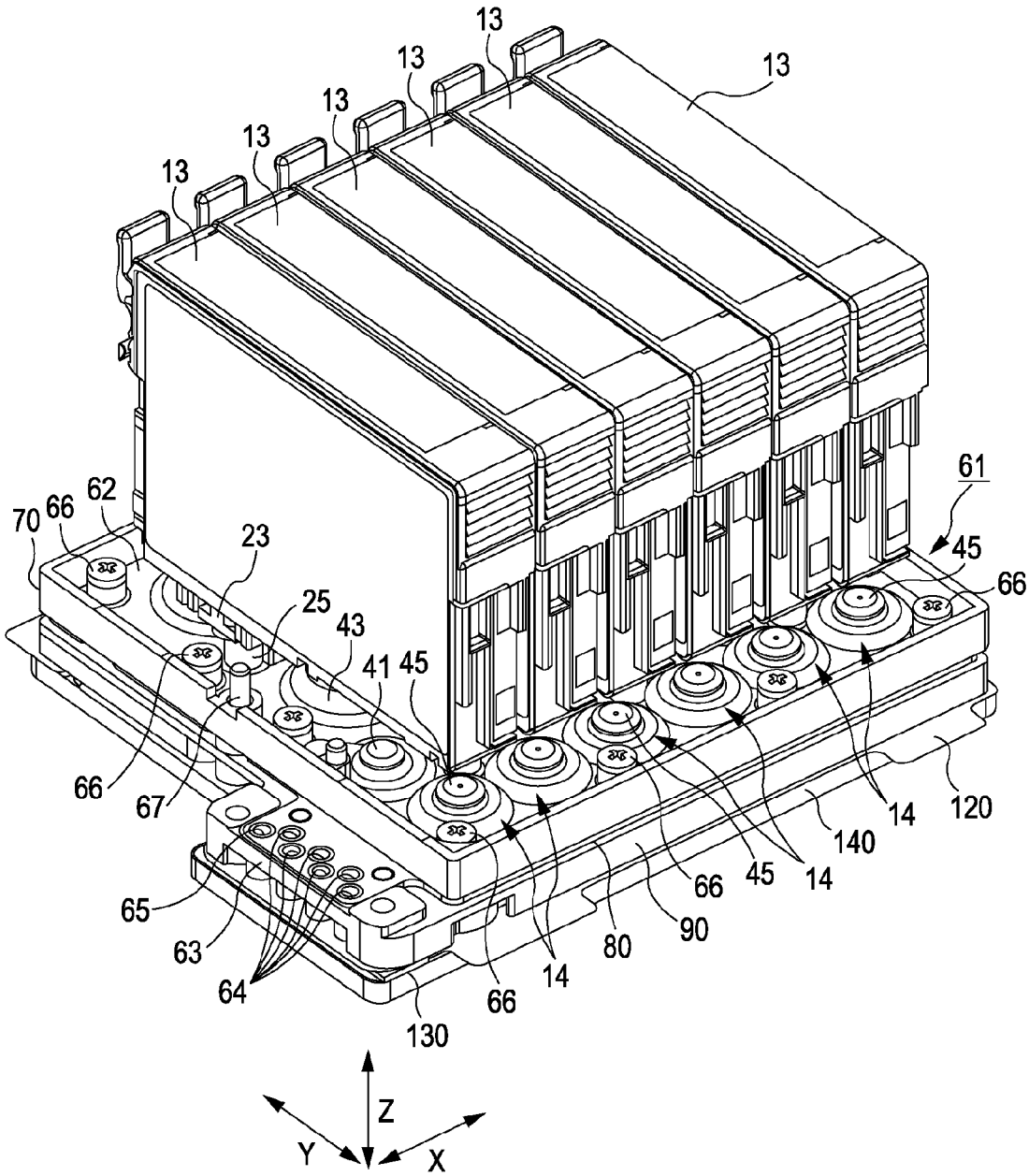
FIG. 3 is a perspective view illustrating an ink supply system mounted with ink cartridges.
Figure 4:
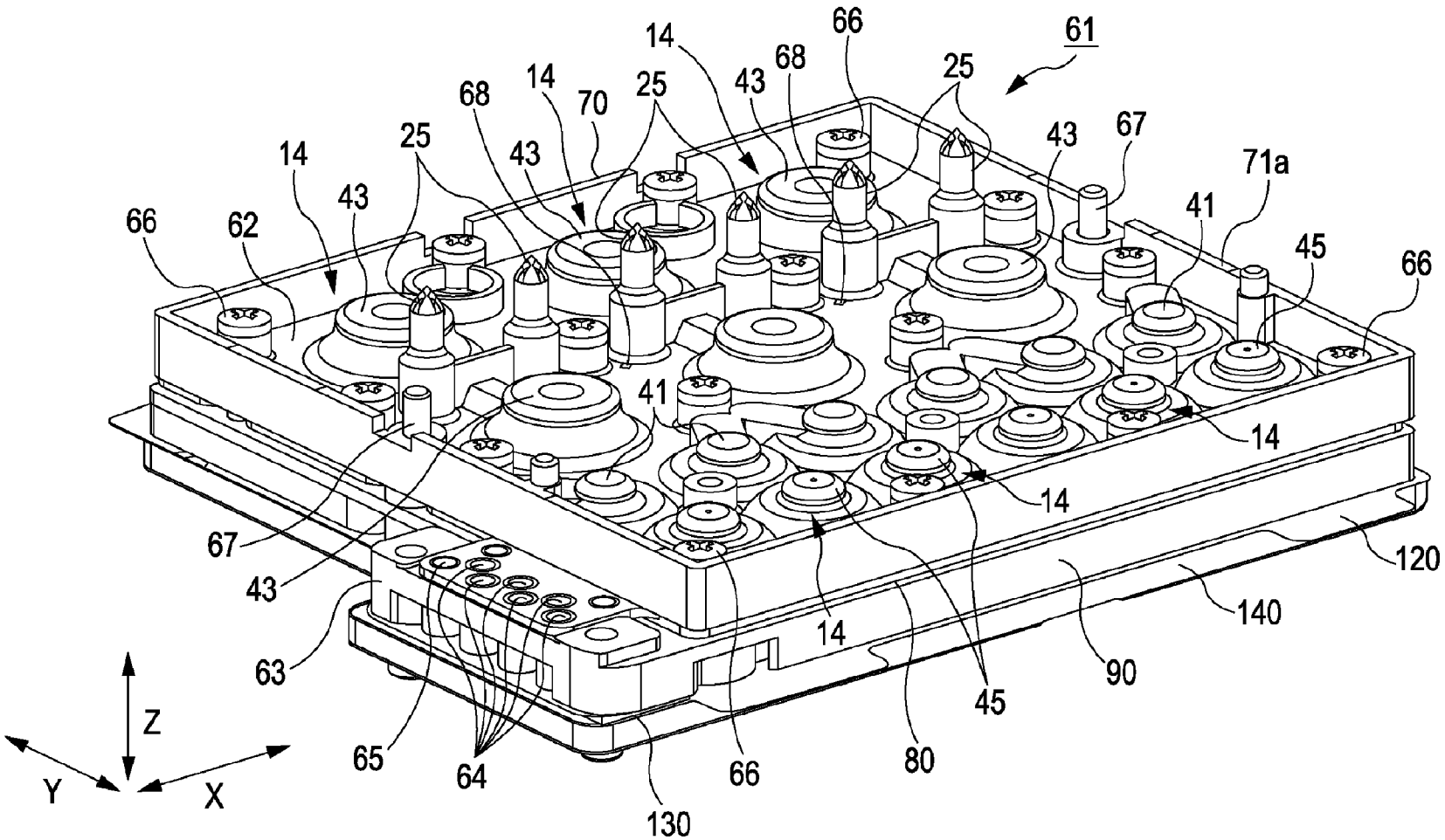
FIG. 4 is a perspective view illustrating the ink supply system.

FIG. 3 is a perspective view illustrating the ink supply system mounted with plural ink cartridges. FIG. 4 is a perspective view illustrating the ink supply system when the ink cartridges are not mounted. Hereinafter, in the following description, a direction parallel to an arrangement direction of the ink supply needles 25 is denoted by an X direction, a direction perpendicular to the arrangement direction of the ink supply needles is denoted by a Y direction, and an upper direction which is perpendicular to the XY plane and a protruding direction of the ink supply needles 25 is denoted by a Z direction.

An ink supply system 61 which is a liquid supply device shown in FIG. 3 is disposed at a predetermined position within the printer 11 and functions as a cartridge holder on which the ink cartridges 13 are mounted. The ink supply system 61 has a lamination structure with a substantially rectangular plate. The ink supply needles 25 (see FIG. 4) arranged in plural rows (in this embodiment, six rows) are disposed in one row in the x direction on the upper surface of the ink supply system so as to protrude perpendicularly (in the Z direction) from the upper surface thereof. The plural (in this embodiment, six) ink cartridges 13 are mounted on the upper side of the ink supply system 61 so as to be nearly adjacent to each other in one row in the X direction by inserting the ink supply needles 25 into the ink supply ports 24 (see FIG. 1) of the pipe unit 23, respectively.

The ink supply system 61 according to this embodiment has a structure in which the six ink supply devices 14 capable of individually supplying six colors such as cyan, magenta, yellow, light cyan, light yellow, and black respectively stored in the six ink cartridges 13 are made into one unit. That is, the ink supply system 61 is capable of using the lamination structure in which plural constituent members having a plate shape are laminated by disposing six pumps 43 (supply pumps), six sucking valves 41 (first unidirectional valves), and six ejecting valves 45 (second unidirectional valves) respectively forming the six ink supply devices 14 on the same plane. In addition, the ink supply system 61 made into one component (one unit) is realized by configuring at least one of the plural constituent members to a single (common) passage forming member and laminating the other constituent members (where the single passage forming member is not necessarily required and the constituent members may be formed in each of the ink supply device). In this embodiment, however, as described below, all the plural constituent members laminated to form the ink supply system 61 are formed as the single forming members that are common to the six ink supply devices 14. The number of the ink supply devices 14 made into one unit as the ink supply system 61 is not limited to six. For example, plural ink supply devices such as two to ten ink supply devices or ten or more ink supply devices may be used. It is not necessary to match with the number of colors (the number of ink cartridges) of the printer 11. For example, two ink supply systems each formed by making three ink supply devices 14 into one unit may be mounted in the printer 11. That is, the plural ink supply systems may be mounted in one printer 11.

As shown in FIGS. 3 and 4, the ink supply system 61 includes a main body 62 which has a rectangular plate shape and includes plural (for example, six) pump 43, sucking valves 41, and ejecting valves 45 corresponding to the number of colors and a pipe connection section 63 which has a plate shape horizontally extending from one end of the main body 62.

As shown in FIG. 4, the main body 62 has the six ink supply needles 25 which protrude from the upper surface of the main body vertically (in the Z direction) so as to be arranged in one row in the X direction therein, the six pumps 43 which are arranged in two rows in the X direction so that each three pumps are arranged in one row, the six sucking valves 41 which are arranged in one row in the X direction, and the six ejecting valves 45 which are arranged in one row in the X direction.

As shown in FIGS. 3 and 4, six ink discharging ports 64 and one negative pressure lead-out port 65 are opened on the upper surface of the pipe connection section 63. The six ink discharging ports 64 each serve as a discharging port which pressurizes and supplies the ink sucked from each ink cartridge 13 by each pump 43 to the outside with a predetermined ejection pressure. The one negative pressure lead-out port 65 serves as a lead-out port which leads out the negative pressure introduced into the ink supply system 61 from the negative pressure generating device 47 (see FIG. 1) to permit the pulsation type pump 43 to perform the sucking drive for another usage (in this embodiment, the defoaming unit 58).

The pipe connection tool 59 (see FIG. 1), which is fixed to one end of a flexible pipe plate in which the six ink supply tubes 15*e* and the one air supply tube 46*c* (see FIG. 1) connected to the printing head unit 12 are bundled onto a flexible plate, is connected to the pipe connection section 63. The ink discharged from each of the ink discharging ports 64 is pressurized and supplied to each of the valve units 17 formed in the printing head unit 12 via each of the ink supply tubes 15*e*. On the other hand, the negative pressure led out from the negative pressure lead-out port 65 upon the sucking drive of the pump 43 is supplied to the defoaming unit 58 formed in the printing head unit 12 via the air supply tube 46*c* (see FIG. 1). In the ink supply system 61 according to this embodiment, a connection tube 106 (see FIG. 16) connected to the air passage pipe 46*a* (see FIG. 1) protrudes from the rear surface. In addition, the air passage 46*b* formed within the ink supply system 61 passes through the inside of a path formed from the connection tube 106 to the negative pressure lead-out port 65 via the negative pressure chamber 43*b* of each pump 43.

The ink supply system 61 has the lamination structure in which the six members 70, 80, 90, 120, 130, and 140 are laminated. The upper five members 70, 80, 90, 120, and 130 forming the ink supply system 61 are fixed at plural positions in a pressurized state in the lamination direction by fastening screws 66 of plural rows (in this embodiment, nineteen screws) by a predetermined fastening force in the lamination direction from the upper side. On the lower side of the lamination structure in which the five members 70, 80, 90, 120, and 130 are fixed by screws 66 of the plural rows, the receiving plate 140 is fixed to the lowermost layer of the lamination structure by fastening two screws 67 in the lamination direction from the lower side.

Figure 5:
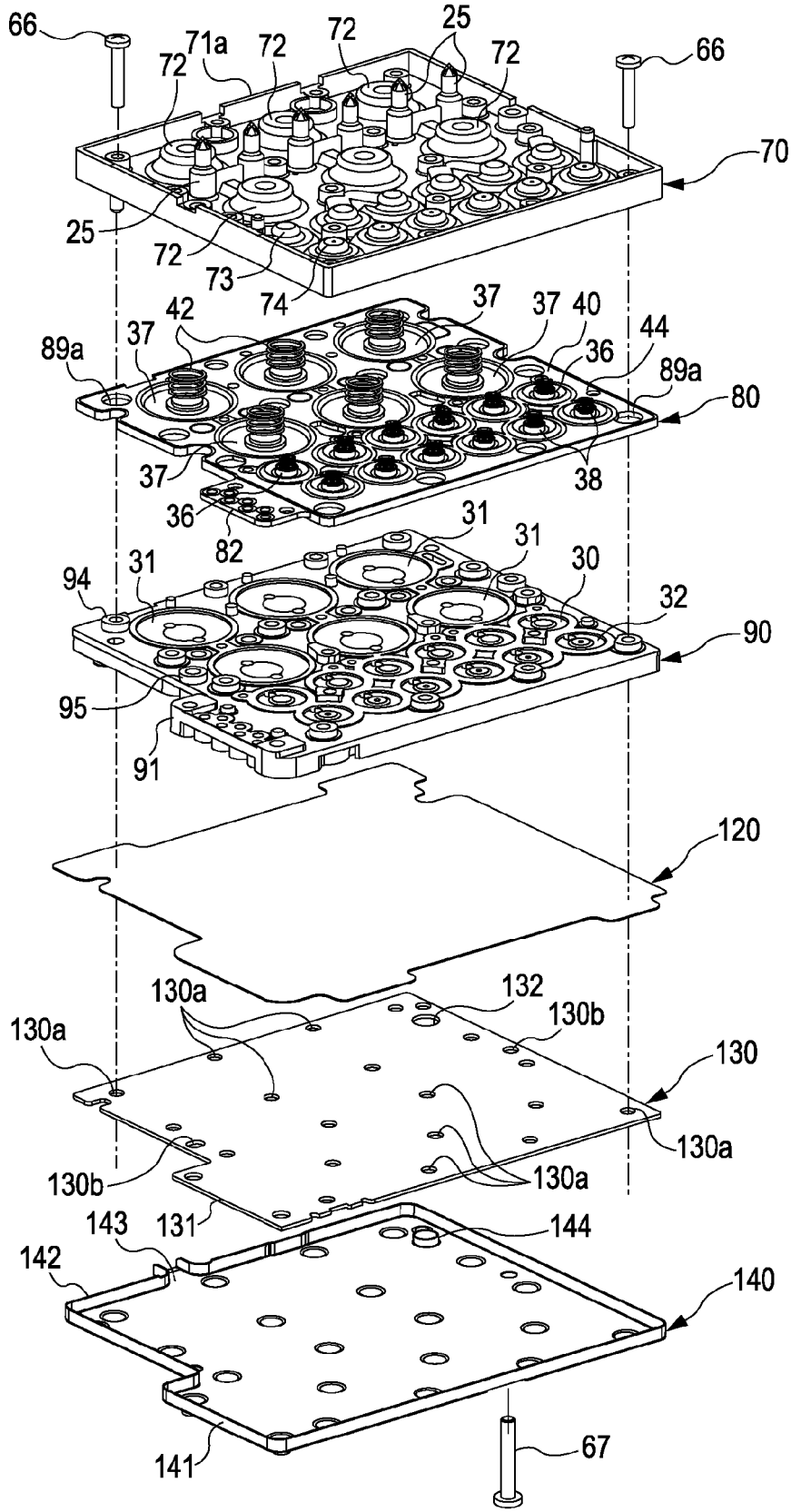
FIG. 5 is an exploded perspective view illustrating the ink supply system.

Hereinafter, the detailed configuration of the ink supply system 61 will be described. FIG. 5 is an exploded perspective view illustrating the ink supply system 61. In FIG. 5, some of the screws are shown. As shown in FIG. 5, the ink supply system 61 includes the cover 70 which has a rectangular plate shape and corresponds to the second passage forming member 28, the diaphragm forming member 80 which corresponds to the flexible member 29, the passage forming plate 90 which corresponds to the first passage forming member 27, the film 120, the protective plate 130, and the receiving plate 140 in this order from the upper side. The film 120 is welded in advance on the rear surface of the passage forming plate 90 before the assembly. Upon the assembly, the coil springs 40, 42, and 44 respectively corresponding to the upper sides of the sucking valve body 36, the diaphragm 37, and the ejecting valve body 38 incorporated into the diaphragm forming member 80 are set. Then, the upper five members 70, 80, 90, 120, and 130 having the rectangular plate shape are fastened with a predetermined tightening force in a vertical direction (the lamination direction) of FIG. 5 by use of the screws 66 of the plural rows (in this embodiment, nineteen screws). By the fastening, it is possible to assemble the lamination structure in which the cover 70, the diaphragm forming member 80, the passage forming plate 90, the film 120, and the protective plate 130 are fixed in the laminated state with the coil springs 40, 42, and 44 accommodated between the cover 70 and the diaphragm forming member 80 in a compressed state. The ink supply system 61 shown in FIG. 4 is formed by disposing the receiving plate 140 on the bottom surface of the lamination structure in which the members 70, 80, 90, 120, and 130 are fixed and fastening the two screws 67 from the lower side to fix the receiving plate 140 on the lowermost layer.

Here, the cover 70, the passage forming plate 90, and the receiving plate 140 are made of a plastic material and formed in a predetermined rectangular plate shape by metal molding (ejection molding, etc.), for example, using a synthetic resin material. The diaphragm forming member 80 is made of elastomer or rubber and formed in a predetermined rectangular plate shape by metal molding (ejection molding, etc.), for example. The film 120 is formed of a laminated film which has a surface made of a synthetic resin material which can be welded with the synthetic resin material of the passage forming plate 90 and is cut in a predetermined substantially rectangular shape. The protective plate 130 is made of a metal material and is punched in a predetermined rectangular plate shape to form plural holes 130*a*, 130*b*, and 132.

The cover 70, the diaphragm forming member 80, and the passage forming plate 90 are constituent members which are laminated in the state where the coil springs 40, 42, and 44 are accommodated and in which the six pumps 43, the six sucking valves 41, and the six ejecting valves 45 are disposed on the same plane. The cover 70 is also used as a board provided with the ink supply needles 25.

Plural grooves 101 to 105 (see FIGS. 15 and 16) for forming the first passage 15*a*, the second passage 15*b*, the third passage 15*c*, the fourth passage 15*d*, and the air passage 46*b* (see FIG. 1 and FIGS. 2A and 2B) are formed on the rear surface of the passage forming plate 90. By welding the film 120 on the rear surface of the passage forming plate 90, the passages 15*a*, 15*b*, 15*c*, and 15*d* and the air passage 46*b* connecting between the ink supply needles 25, the sucking valves 41, the pumps 43, and the ejecting valves 45 are formed on the rear surface of the passage forming plate 90.

The reason to use the sucking valves 41, the ejecting valves 45, and the coil springs 40 and 44 is to ensure the closed state of the check valves (the unidirectional valve). For example, when the ejecting valve 45 is not fully closed and thus the ink leaks, an amount of ink flowing in the ink passage of each color becomes irregular. Moreover, when the sucking valve 41 is not fully closed and thus the ink leaks, the ink flowing backward comes out unnecessarily from the ink supply needle 25 in a case where the ink cartridge 13 is detached, for example. In this way, when the ink is unnecessarily consumed, a difference in the amounts of ink of respective colors consumed occurs. For this reason, the check valves of the sucking valve body 36 and the ejecting valve body 38 require a configuration for preventing the ink from leaking. In this embodiment, the urging coil springs 40 and 44 are provided in addition to the diaphragm type valve bodies 36 and 38. Of course, when this configuration is used, it is necessary to broaden the diaphragm areas of the valve bodies 36 and 38 so as to open the valves against the urging force of the coil springs 40 and 44, and the valves 41 and 45 are required to have the broad disposition area.

In this embodiment, the check valve structure requiring this broad disposition area is used to ensure reliability, but other structures may be realized to save a space. For example, almost all of the pumps 43 and the valves 41 and 45 are disposed within a projection range of the ink cartridges 13 before the ink cartridges are mounted on the ink supply system 61 and the ink supply system 61 is formed in a substantially same plane size as that of the projected area.

In the ink supply system 61 according to this embodiment, the pumps 43 and the valves 41 and 45 are disposed very precisely within a predetermined rectangular area by arranging the six pumps 43 having a relatively large diameter in two rows so as to be nearly adjacent to each other and arranging the six sucking valves 41 and the six ejecting valves 45 having a relatively small diameter, which is the substantially half of the diameter of the pump 43, in one row so as to be nearly adjacent to each other in the adjacent area of the pumps. In addition, each of the ink supply needles 25 is disposed in the gap between the rows of the pumps 43. With such a layout, the ink supply system 61 can be configured so as to have a small thickness and a small plane size. However, when the precise layout is used, the ink supply needle 25 and the sucking valve 41, the sucking valve 41 and the pump 43, and the pump 43 and the ejecting valve 45 are relatively distant from each other, respectively. Moreover, the passage lengths of the first passage 15*a*, the second passage 15*b*, the third passage 15*c*, the fourth passage 15*d*, and the air passage 46*b* may be relatively long. Accordingly, by disposing the first passage 15*a*, the second passage 15*b*, the third passage 15*c*, the fourth passage 15*d*, and the air passage 46*b* on the rear surface of the passage forming plate 90, the effective layout of the lengthened passages 15*a*, 15*b*, 15*c*, 15*d*, and 46*b* can be achieved without sacrificing the precise layout (that is, the reduction in the plane size) of the pumps 43 and the valves 41 and 45.

Next, the configuration of each member of the ink supply system 61 will be described.

Figure 6:
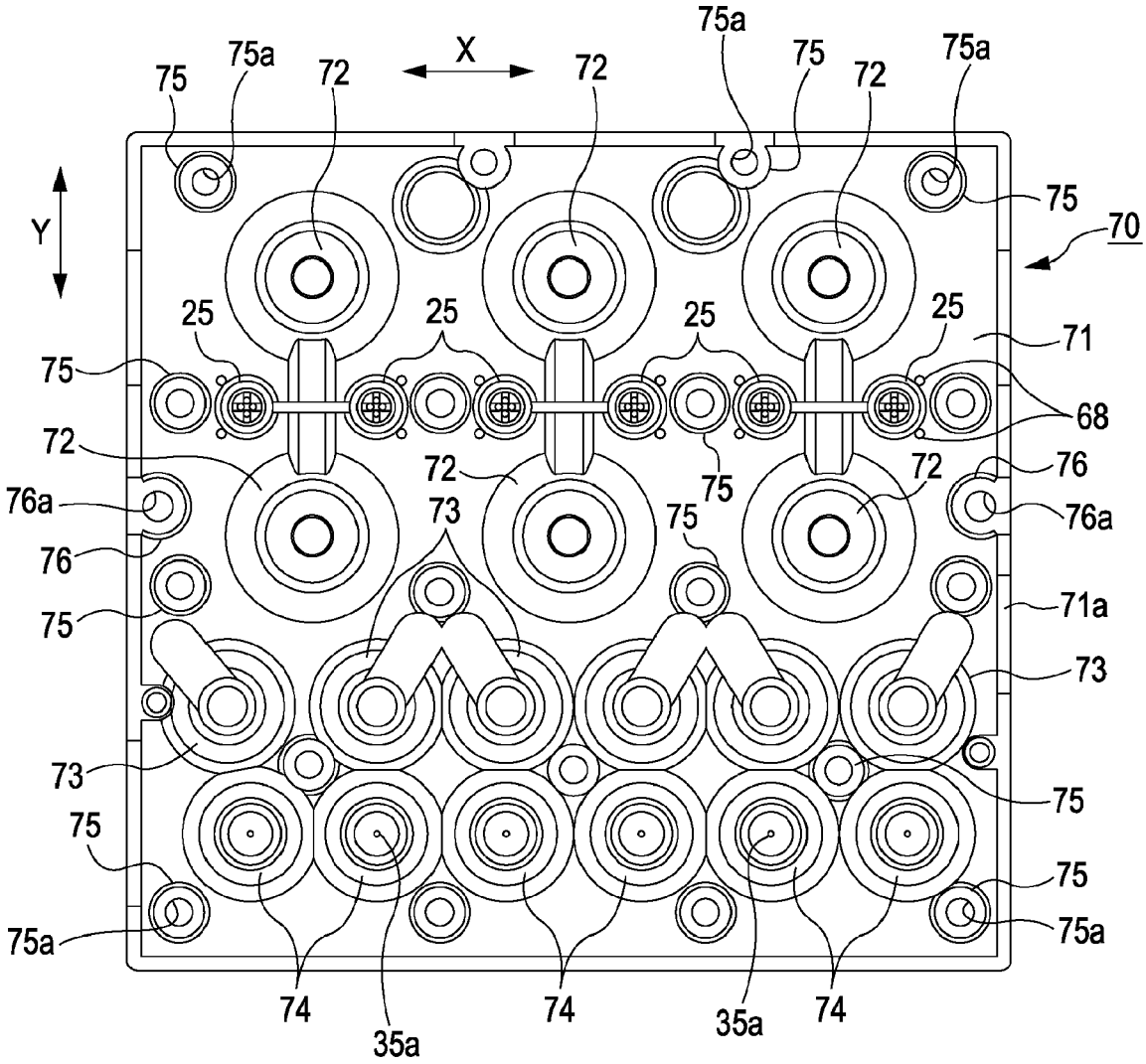
FIG. 6 is a plan view illustrating a cover.
Figure 7:
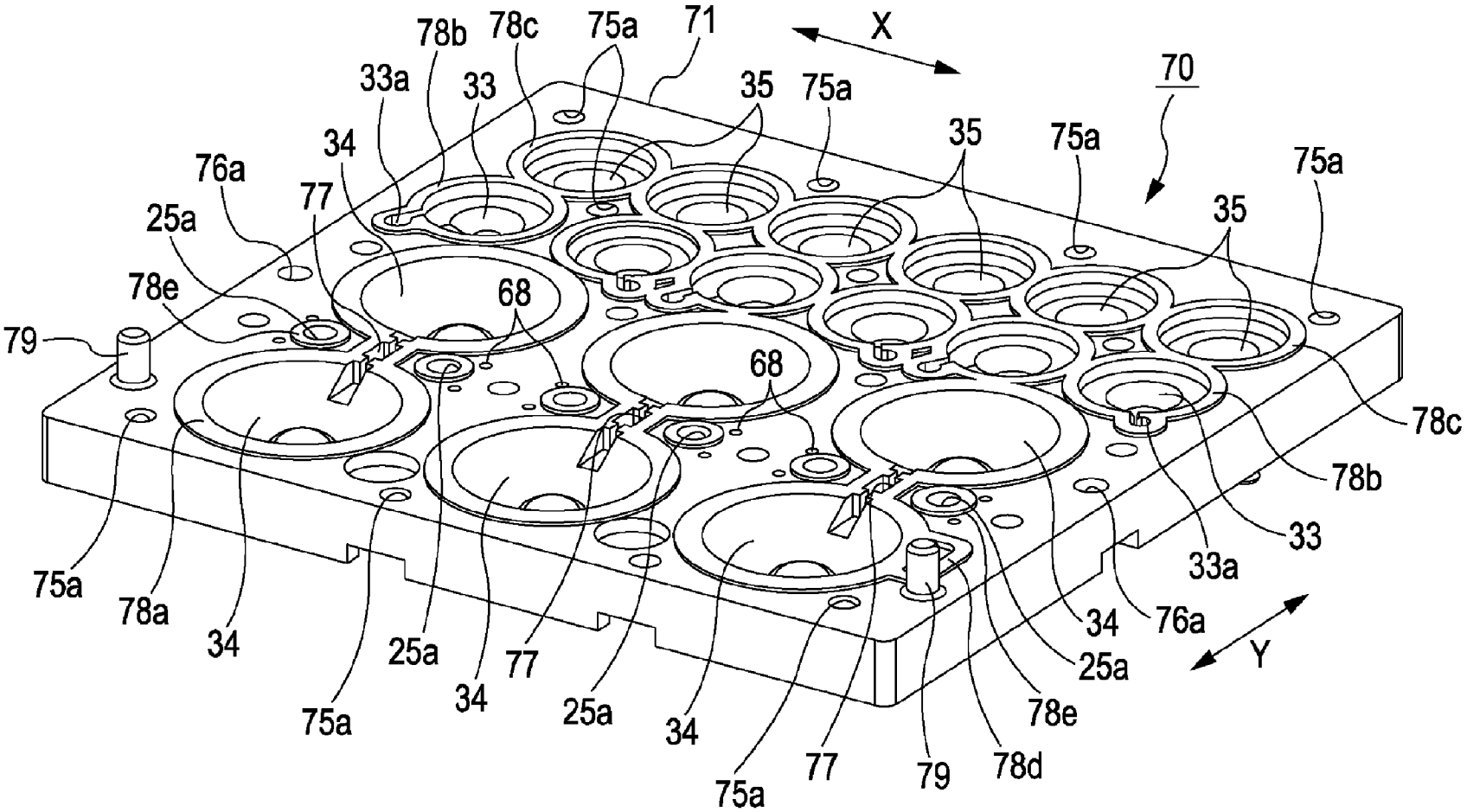
FIG. 7 is a perspective view illustrating the rear surface of the cover.
Figure 8:
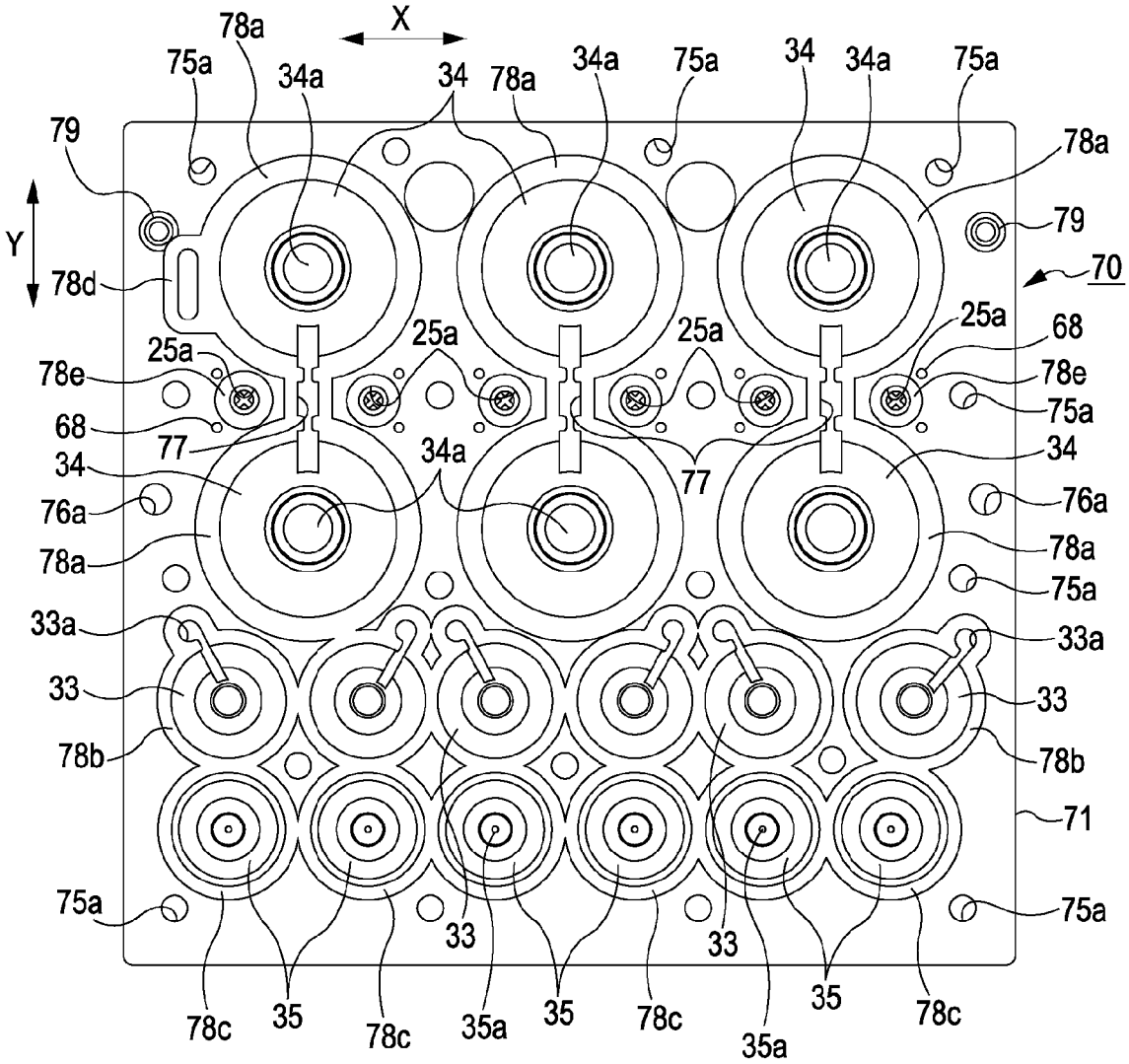
FIG. 8 is a bottom view illustrating the cover.

FIG. 6 is a plan view illustrating the front surface of the cover. FIG. 7 is a perspective view illustrating the rear surface of the cover. FIG. 8 is a bottom view illustrating the rear surface of the cover.

As shown in FIGS. 4 and 6, the cover 70 includes a board 71 which has a rectangular plate shape and in which the ink supply needles 25 of the plural rows protrude from the upper surface (the front surface). In a substantially ⅔ area of the upper surface of the board 71 in the vicinity of the location where the ink supply needles 25 are arranged in row, six pump housing sections 72 swelled in a substantially conic frustum shape toward the upper side (in the Z direction) are arranged in two rows at a uniform interval in the X direction so that three pump housing sections are arranged in one row.

The six ink supply needles 25 are arranged in gap areas, which correspond to row spaces between the pump housing pumps 72 arranged in two rows, at a uniform pitch (a pitch slightly broader than the width of the ink cartridge 13 in the X direction) in the X direction. At this time, the six ink supply needles 25 are located on both sides interposing the line segments connecting the central points of the three pairs of pump housing sections 72 each paired in the Y direction in a plan view of FIG. 6.

Through-holes 68 perforated through the cover 70 in a vertical direction are formed in the peripheral of each of the ink supply needles 25. In addition, when the ink leaks to the peripherals of the ink supply needles 25 upon mounting or detaching the ink cartridges 13 on the ink supply needles 25 of the ink supply system 61, the leaking ink is discharged from the front surface of the cover 70 to the rear surface via the through-holes 68. In this embodiment, two through-holes 68 are formed for each one of the ink supply needles 25.

In the substantially remaining ⅓ area of the upper surface of the board 71, six sucking valve housing sections 73 swelled in the substantially conic frustum shape having a diameter smaller than that of the pump housing section 72 and six ejecting valve housing sections 74 swelled in a substantially conic frustum shape having almost the same diameter as that of the sucking valve housing section are respectively arranged in one row so as to be nearly adjacent in the X direction. The six sucking valve housing sections 73 are arranged in the vicinity of the rows of the second pump housing sections 72 from the upper side in FIG. 6 and the six ejecting valve housing sections 74 are arranged in the vicinity of the row of the sucking valve housing sections 73. The six sucking valve housing sections 73 and the six ejecting valve housing sections 74 are located so as to be also nearly adjacent in the Y direction.

On the front surface of the cover 70, an extension section 71*a* having a predetermined height is formed on nearly four sides so as to surround the circumference. Plural (nineteen) boss sections 75 having a screw insertion hole 75*a* protrude at positions where the screws 66 are fastened in the board 71. In addition, plural (two) boss sections 76 having a screw insertion hole 76*a* protrude at positions where the screws 67 are fastened in the board 71. The plural boss sections 75 are arranged at the positions on the inside of the extension section 71*a* at almost the same interval along the inner circumference and at the positions corresponding to the row spaces of the housing sections 72 to 74 at almost the same interval in the X direction. One pair of boss sections 76 are formed at the positions of the both sides interposing the second pump housing sections 72 in X direction.

As shown in FIGS. 7 and 8, on the rear surface of the cover 70 the six concave sections 34 having a concave shape and forming the negative chamber 43*b* are formed at the positions corresponding to the pump housing sections 72. In addition, on the rear surface of the cover 70, six concave sections 33 having a concave shape are formed at the positions corresponding to the sucking valve housing sections 73 and six concave sections 35 having a concave shape are formed at the positions corresponding to the ejecting valve housing sections 74. The concave sections 33, 34, and 35 are formed in the substantially conic frustum shape on the inner circumferential surface having a concave shape. The concave sections 33 and 35 have a smaller diameter which is the substantial half of the diameter of that of the concave sections 34.

Columnar convex portions 34*a* into which the upper end of the coil spring 42 (see FIGS. 1 and 9) is inserted outwardly protrude from the bottoms of the concave sections 34. The inner diameter of the bottom of the concaves 33 and 35 is slightly larger than the outer diameter of the coil springs 40 and 44, and the upper end of the coil springs 40 and 44 coming in contact with the bottom of the concaves can be positioned at the substantial middle of the concave sections 33 and 35. An air communication hole 35*a* having a small diameter is formed at the middle of the bottom surface of the concave 35. Due to the presence of the air communication hole 35*a*, the ejecting valve 45 functions as a choke valve for increasing the negative pressure of the downstream area by closing the valve when the ink is forcibly sucked from the nozzles 16 upon cleaning the printing head 57.

On the rear surface of the cover 70, six through-holes 25*a* individually communicating with the ink supply needles 25 are formed at the positions individually corresponding to the ink supply needles 25 at a uniform pitch in X direction.

A groove 77 permitting the two concave sections 34 adjacent to each other to communicate with each other in the Y direction is formed on the rear surface of the cover 70. The groove 77 forms a part of the air passage 46*b* for introducing the negative pressure into the two concave sections 34 (that is, the negative pressure 43*b*) located at the positions on both the sides in the length direction. In addition, a groove 33*a* extending by a predetermined distance from each concave section 33 to the outside in a diameter direction is formed on the rear surface of the cover 70. The groove 33*a* forms a part of the second passage 15*b* for supplying the ink in the sucking valve 41 to the pump chamber 43*a*.

A sealing portion 78*a* which has a substantially 8-shape and extends in a strip shape having a nearly uniform width along the circumference of the two concave sections 34 adjacent to each other in the Y direction and the circumference of the groove 77 permitting both the concave sections 34 to communicate with each other is formed on the rear surface of the cover 70. A sealing portion 78*b* which extends in a strip shape with a nearly uniform width along the circumference of the concave section 33 and the groove 33*a* is formed. Moreover, a sealing portion 78*c* which extends in a strip shape with a nearly uniform width along the circumference of the concave section 35 is formed. A sealing portion 78*d* having a ring shape surrounding a long elliptical area is formed in the most left concave section 34 located in the first row in FIG. 8 so as to be conjunctive to the sealing portion 78*a*. A sealing portion 78*e* having a ring shape with a uniform width is also formed in the circumference of each through-hole 25*a*. The sealing portions 78*a* to 78*e* are formed in a convex shape with a height of the range from about several 10 μm to about several 100 μm from the bottom surface of the cover 70. A pair of positioning pins 79 protrude from the rear surface of the cover 70 at both the sides interposing the concave sections 34 located in the first row in the X direction. These pins 79 are used to position the cover 70 to the passage forming plate 90.

Next, the configuration of the diaphragm forming member 80 will be described.

Figure 9:
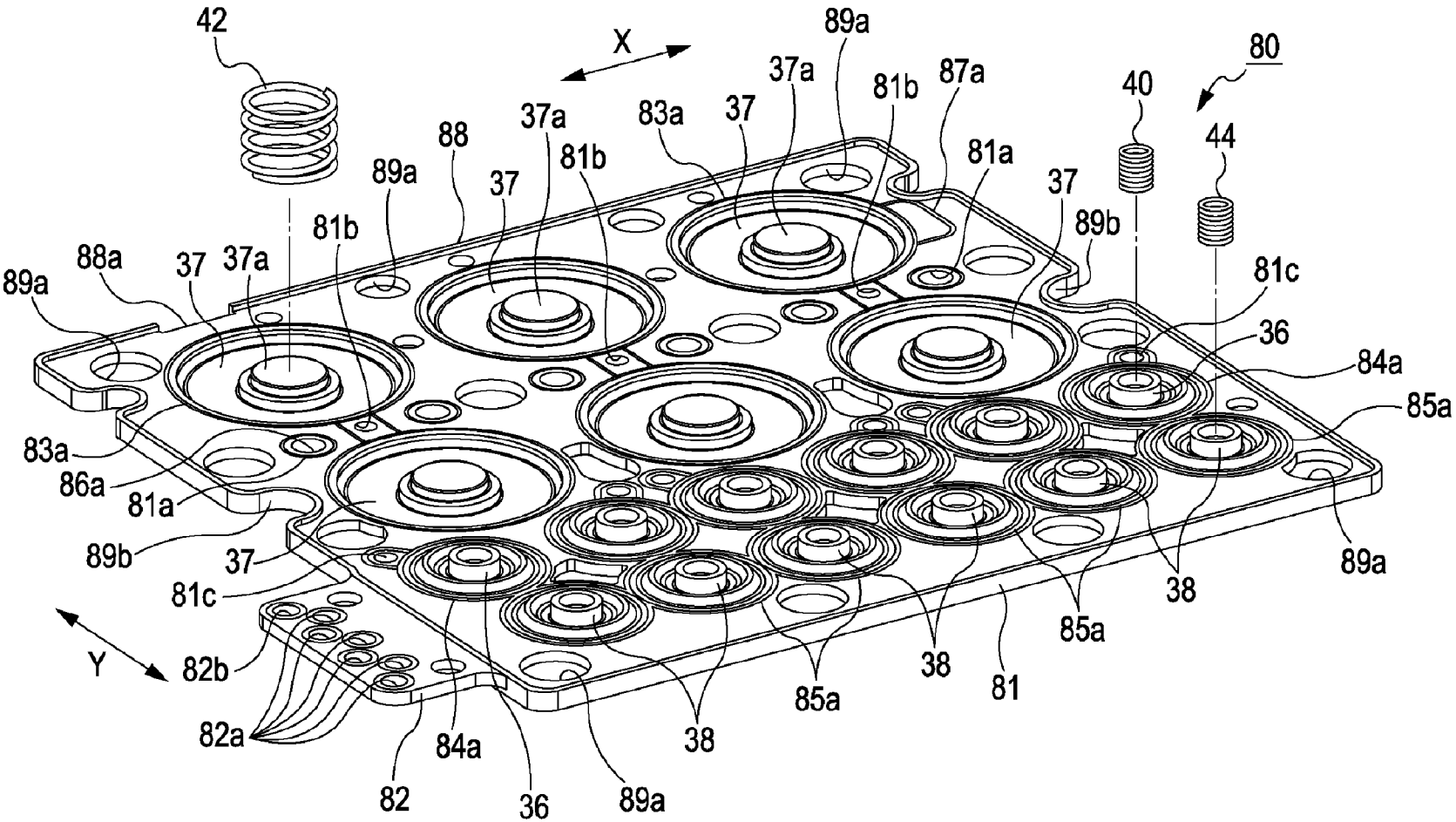
FIG. 9 is a perspective view illustrating a diaphragm forming member and a coil spring.
Figure 10:
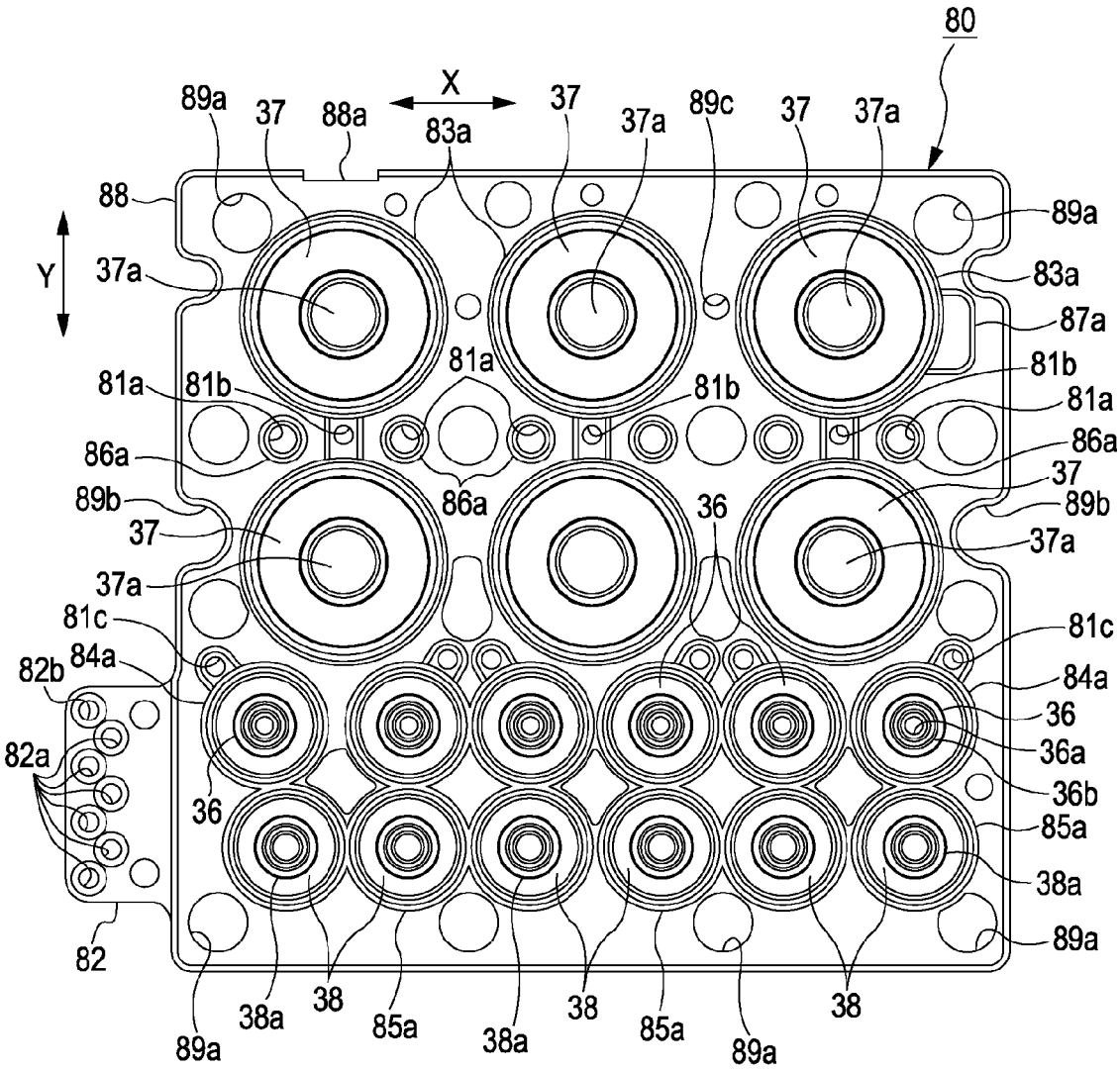
FIG. 10 is a plan view illustrating the diaphragm forming member.
Figure 11:
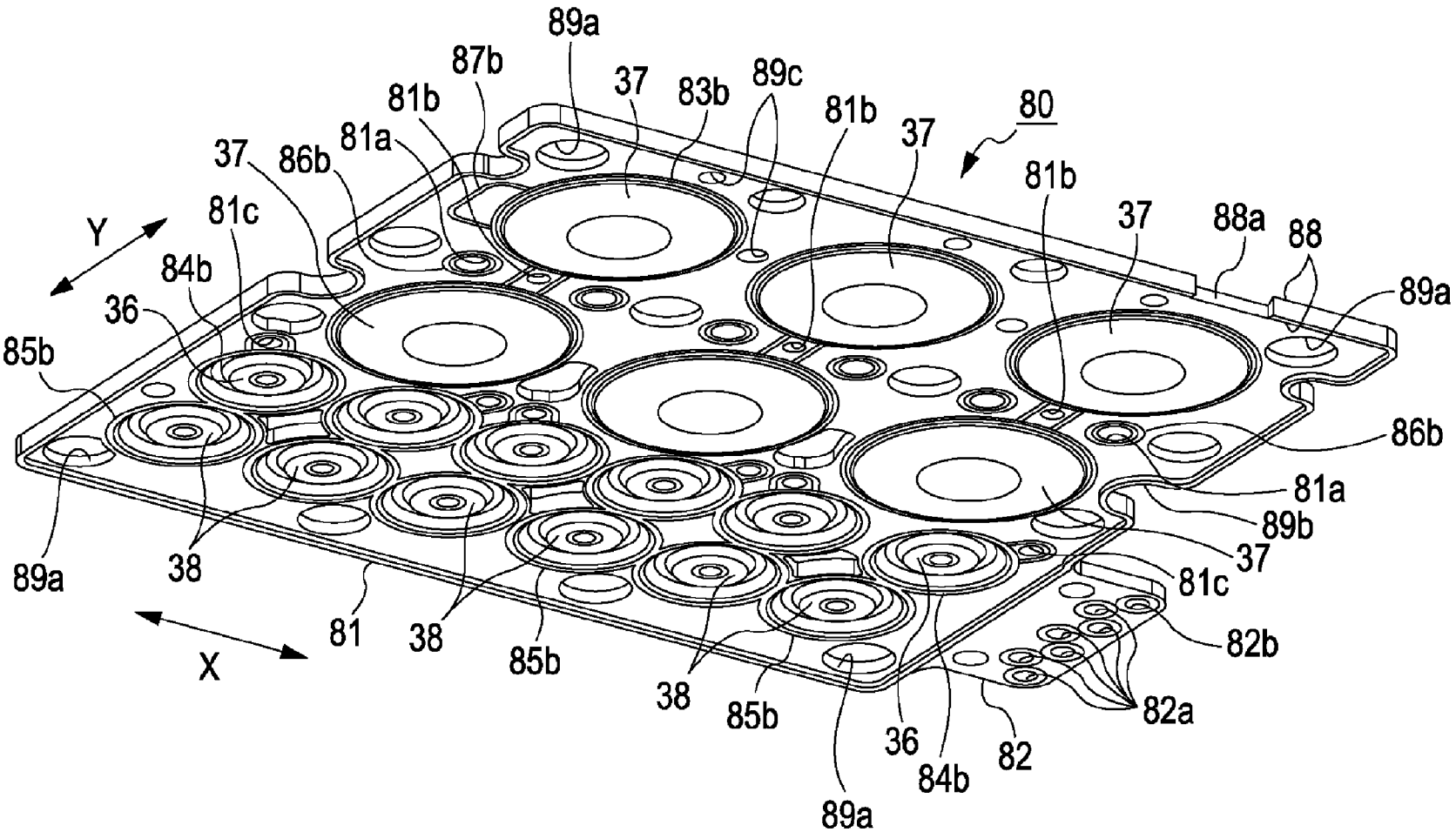
FIG. 11 is a perspective view illustrating the rear surface of the diaphragm forming member.
Figure 12:
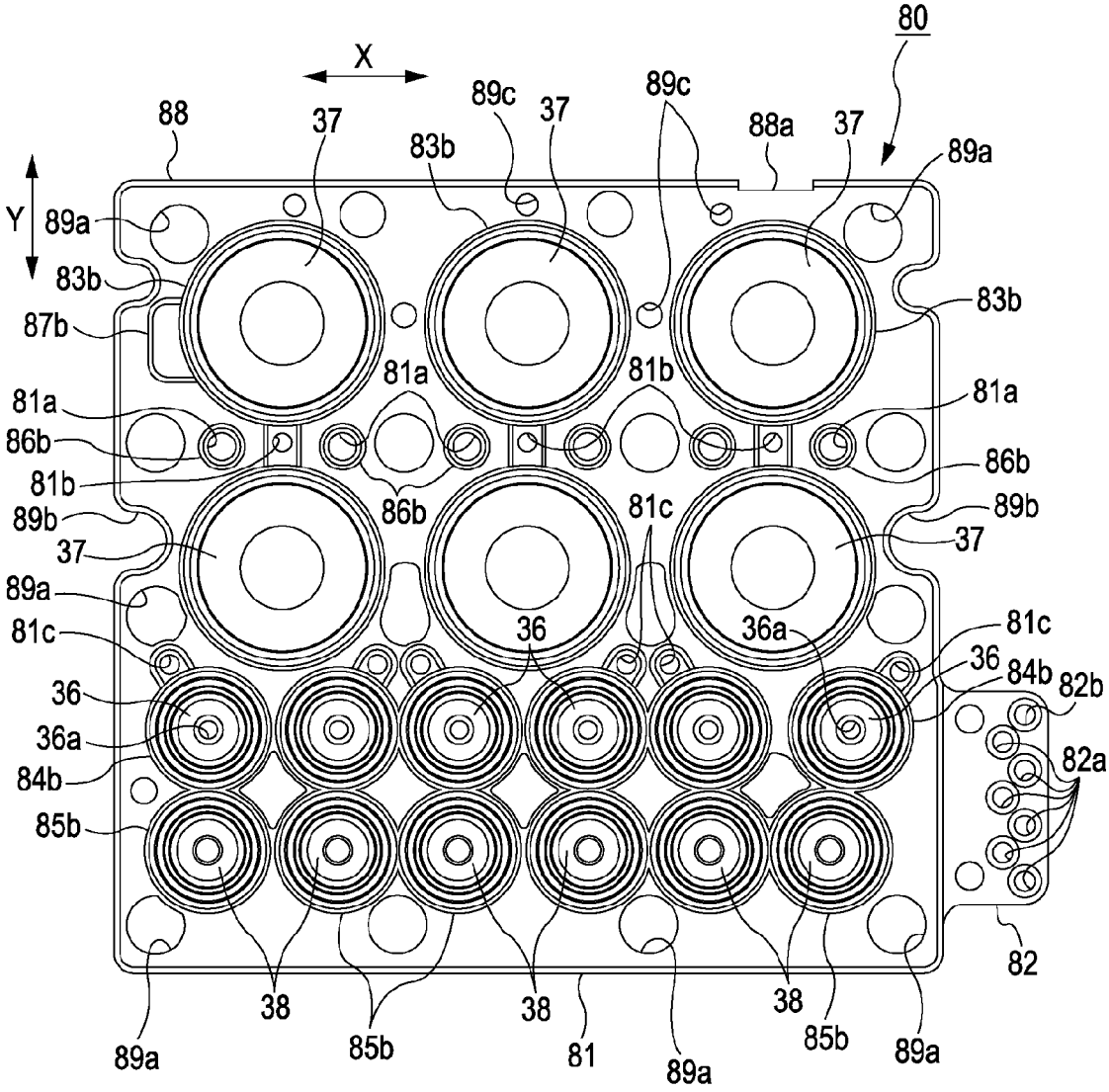
FIG. 12 is a bottom view illustrating the diaphragm forming member.

FIG. 9 is a perspective view illustrating the diaphragm forming member when viewed from the upper side. FIG. 10 is a plan view illustrating the diaphragm forming member. FIG. 11 is a perspective view illustrating the diaphragm forming member when viewed from the rear surface. FIG. 12 is a bottom view illustrating the diaphragm forming member.

The diaphragm forming member 80 shown in FIGS. 9 to 12 is made of rubber having rubber elasticity or elastomer. The diaphragm forming member 80 includes a sheet main body 81 which has a substantially rectangular shape having almost the same size as that of the cover 70 and an extension section 82 which extends from one end (the left lower end in FIG. 10) of the sheet main body 81 and forms a sealing portion of the pipe connection section 63. The sheet main body 81 is provided with the six diaphragms 37 which each have a circular disk shape and are disposed at the positions corresponding to the concave sections 34 of the cover 70, the six sucking valve bodies 36 which are disposed at the positions corresponding to the concave sections 33, and the six ejecting valve bodies 38 which are disposed at the positions corresponding to the concave sections 35. The diaphragm 37 has a large diameter to correspond to the concave section 34. The sucking valve body 36 and the ejecting valve body 38 have a small diameter which is the about half of that of the diaphragm 37 to correspond to the concave sections 33 and 35, respectively.

As shown in FIGS. 9 and 10, the diaphragm 37 has a flat columnar convex portion 37*a* at the middle of the upper surface. One end (the lower end) of the coil spring 42 is inserted outwardly into the convex portion 37*a* to position the coil spring.

As shown in FIGS. 9 to 12, in the gap areas which are the row spaces between the diaphragms 37 arranged in two rows in the diaphragm forming member 80, six through-holes 81*a* are formed at the positions corresponding to the through-holes 25*a* of the ink supply needles 25 of the cover 70. Three through-holes 81*b* are formed at the positions between the through-holes 81*a* in the X direction, that is, the positions corresponding to the lines connecting the central points of the three pairs of diaphragms 37 arranged in the Y direction, respectively. The three through-holes 81*b* forms a part of the air passage 46*b* for introducing the negative pressure into the negative pressure chamber 43*b* together with the grooves 77 of the cover 70.

Six through-holes 81*c* are formed in the vicinities of the sucking valve bodies 36 in the diaphragm forming member 80, respectively. The through-holes 81*c* form a part of the second passage 15*b* permitting the sucking valve 41 to communicate with the pump 43 and individually communicate with the front end of the grooves 33*a* (see FIGS. 7 and 8) formed on the rear surface of the cover 70.

As shown in FIGS. 9 and 10, a cylindrical portion 36*b* having the through-hole 36*a* (see FIG. 1) protrudes at the middle of the sucking valve body 36. The lower end of the coil spring 40 urging the sucking valve body 36 toward the lower side is inserted inwardly into the cylindrical portion 36*b* to position the coil spring. A cylindrical portion 38*a* having a bottom surface protrudes at the middle of the ejecting valve body 38. The lower end of the coil spring 44 urging the ejecting valve body 38 toward the lower side is inserted inwardly into the cylindrical portion 38*a* to position the coil spring.

As shown in FIGS. 9 and 10, the upper surface (the front surface) of the diaphragm forming member 80 is provided with a sealing portion 83*a* which seals the circumference of the two diaphragms 37 arranged in the Y direction and the circumference of the through-hole 81*b*, a sealing portion 84*a* which seals the circumferences of the sucking valve body 36 and the through-hole 81*c*, and a sealing portion 85*a* which seals the circumference of the ejecting valve body 38. As shown in FIGS. 11 and 12, the rear surface (the lower surface) of the diaphragm forming member 80 is provided a sealing portion 83*b* which seals the circumference of the two diaphragms 37 arranged in the Y direction and the circumference of the through-hole 81*b*, a sealing portion 84*b* which seals the circumferences of the sucking valve body 36 and the through-hole 81*c*, and a sealing portion 85*b* which seals the circumference of the ejecting valve body 38.

As shown in FIGS. 9 to 12, on the upper surface and the lower surface of the diaphragm forming member 80, sealing portions 86*a* and 86*b* having a ring shape are formed in the circumference of each through-hole 81*a*, respectively. On the upper surface and the lower surface of the diaphragm forming member 80, sealing portions 87*a* and 87*b* are formed at the positions corresponding to the sealing portion 78*d* of the cover 70. In addition, the sealing portions 83*a* to 87*a* and the sealing portions 83*b* to 87*b* are formed in a convex shape with the height of about several 10 μm to about several 100 μm, for example, from the bottom surface, and formed so as to be thinner than the corresponding sealing portions of the cover 70 and located in correspondence with the nearly middle in the width direction of the corresponding sealing portions of the cover 70. The sealing portions 83*a* to 87*a* on the front surface of the diaphragm forming member 80 and the sealing portions 83*b* to 87*b* on the rear surface thereof are formed so as to be plane-symmetry, respectively.

On the front and rear surfaces of the diaphragm forming member 80, a sealing portion 88 having a convex shape extending vertically from the front and rear surfaces is formed in the nearly whole circumference along the circumference of the sheet main body 81. A notch 88*a* is formed at one position in the circumferential direction of the sealing portion 88. The circumference between the cover 70 and the diaphragm forming member 80 and the circumference between the diaphragm forming member 80 and the passage forming plate 90 are sealed by the sealing portion 88 so that a liquid does not leak in portions other than the notch 88*a*. The ink leaking from the seal of the ink passages is accumulated at a gap between the cover 70 and the diaphragm forming member 80 or a gap between the diaphragm forming member 80 and the passage forming plate 90, but the accumulated waste ink flows and drops from the notch 88*a* to the outside.

The extension section 82 of the diaphragm forming member 80 is provided with six through-holes 81*c* serving as the ink discharging ports 64 and one through-hole 82*b* serving as the negative pressure lead-out port 65. The diaphragm forming member 80 is provided with plural screw insertion holes 89*a*, into which the screws 66 and 67 are inserted and concave portions 89*b*. Plural pin holes 89*c* are formed in the peripherals of the diaphragms 37 located in the first row.

Figure 13:
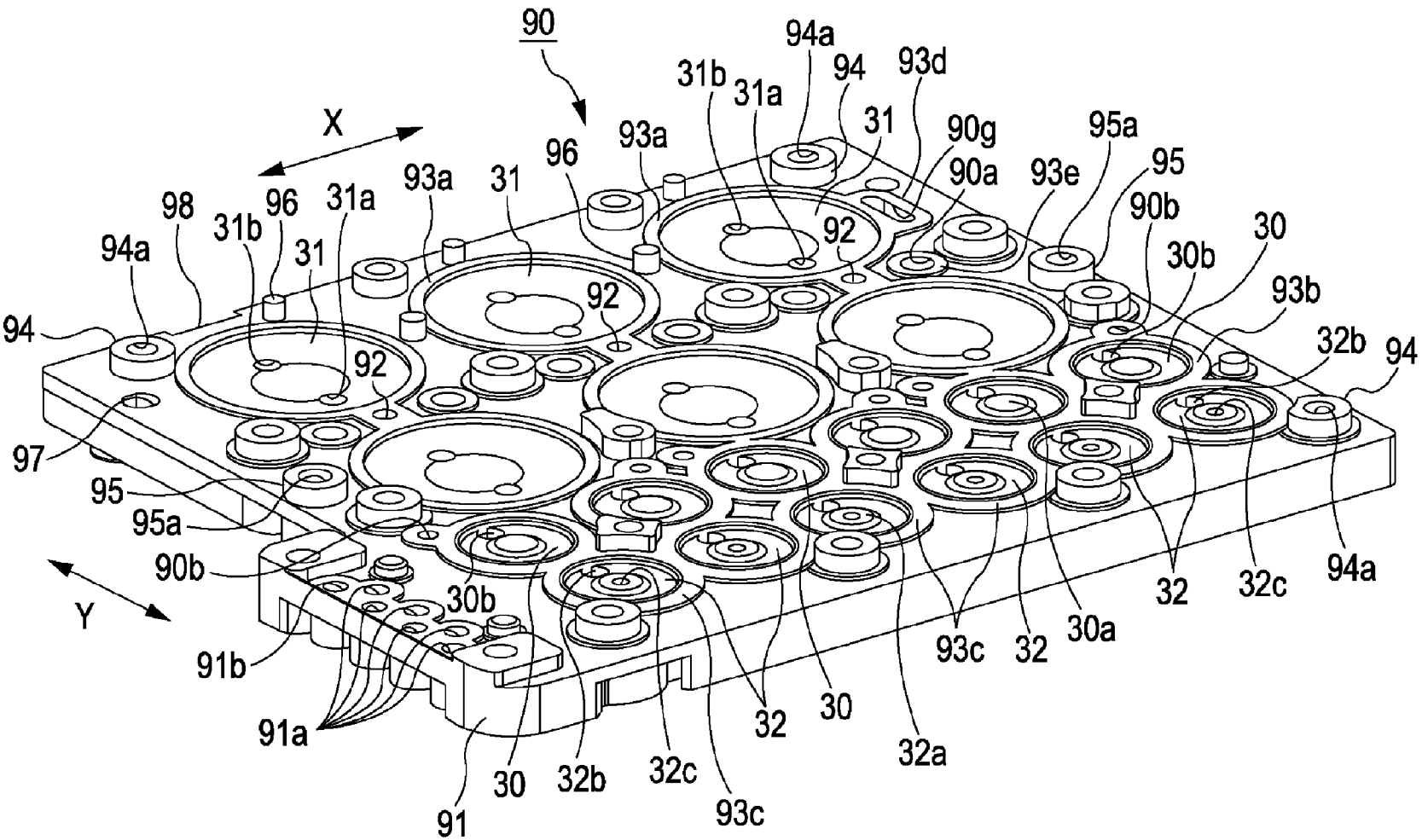
FIG. 13 is a perspective view illustrating the upper surface (the front surface) of a passage forming plate.
Figure 14:
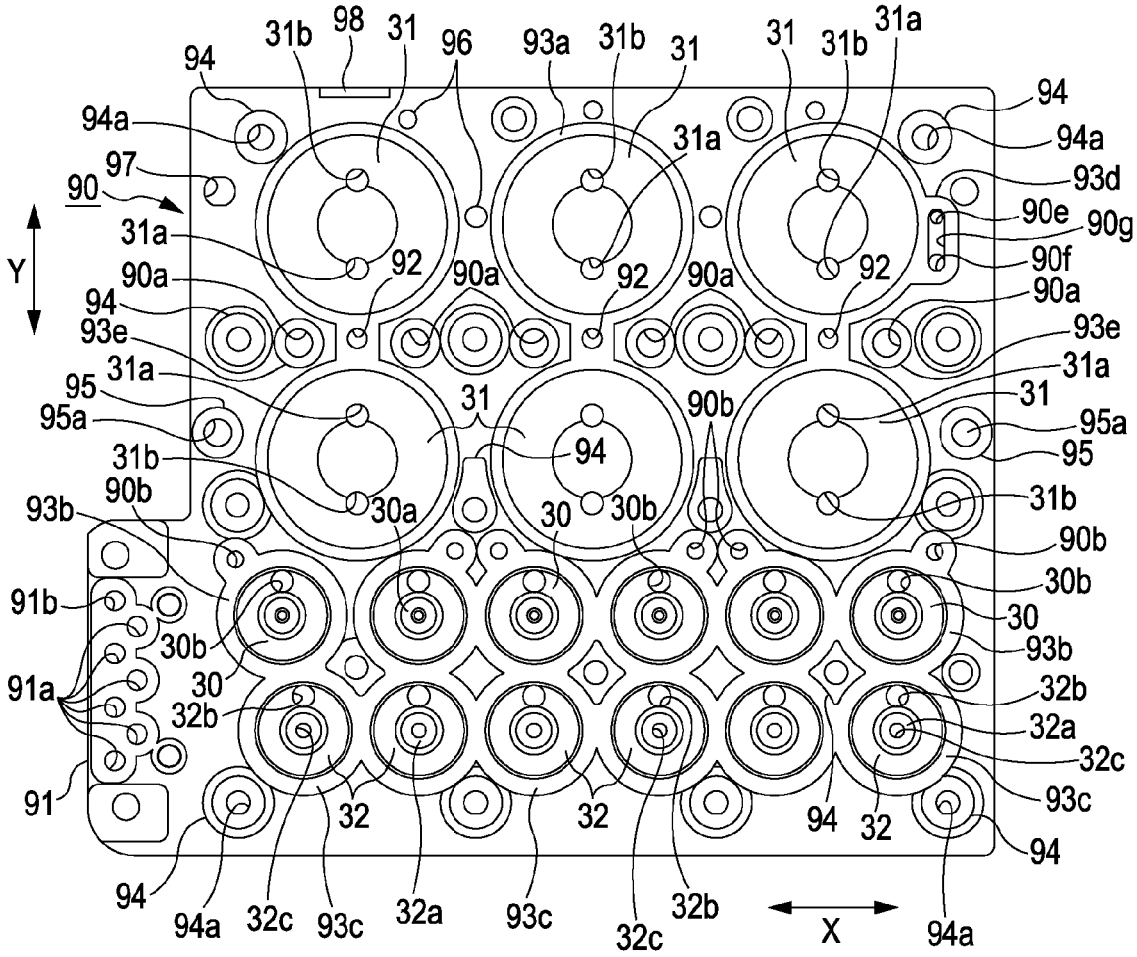
FIG. 14 is a plan view illustrating the passage forming plate.
Figure 15:
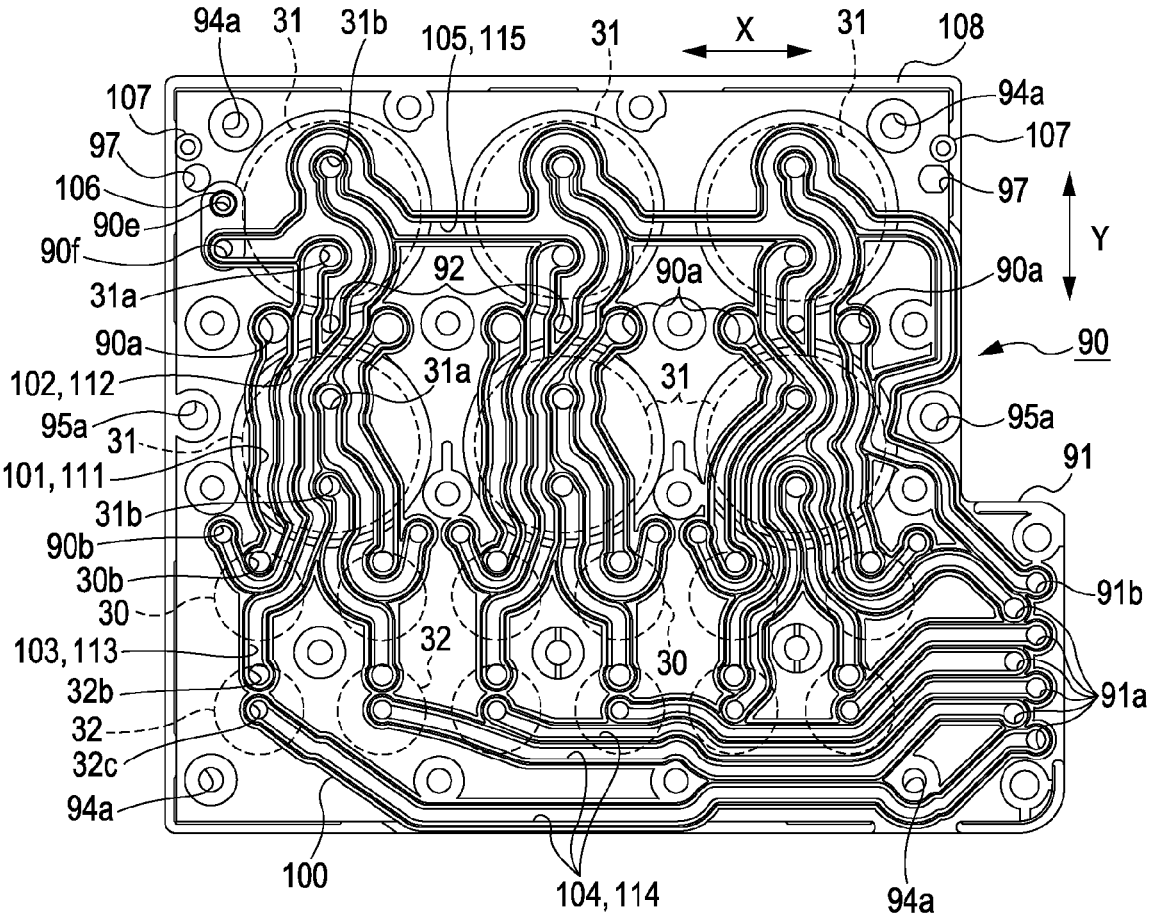
FIG. 15 is a bottom view illustrating the passage forming plate.
Figure 16:
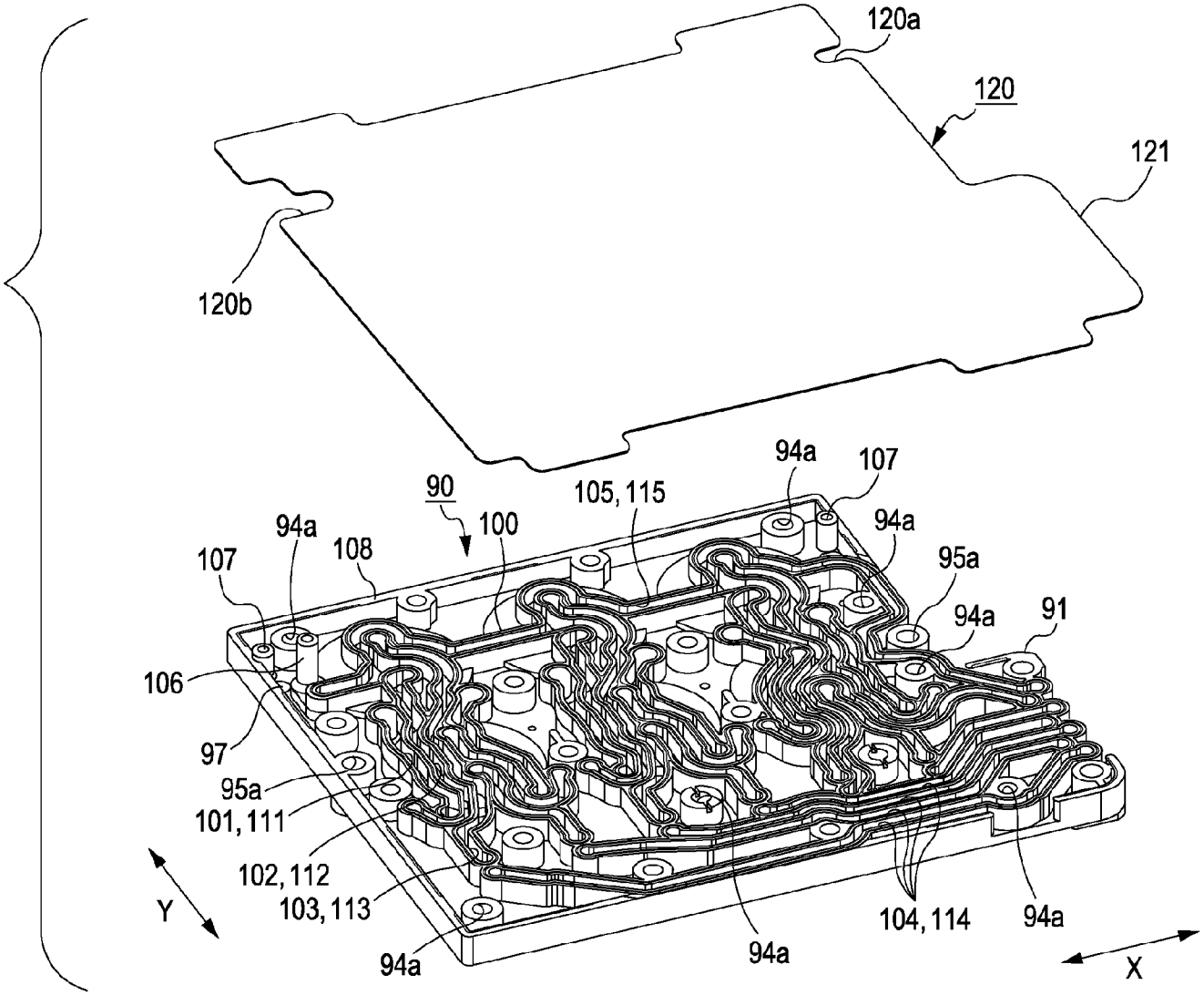
FIG. 16 is an exploded perspective view illustrating the passage forming plate and a film.

Next, the configuration of the passage forming plate 90 will be described. FIG. 13 is a perspective view illustrating the passage forming plate when viewed from the upper surface side. FIG. 14 is a plan view illustrating the upper surface of the passage forming plate. FIG. 15 is a bottom view illustrating the rear surface (the bottom surface) of the passage forming plate. FIG. 16 is an exploded perspective view illustrating the passage forming plate and a film. In addition, in FIG. 15, reference numerals of passages corresponding to grooves are also given.

The passage forming plate 90 shown in FIGS. 13 to 16 includes an extension section 91 at the position corresponding to the extension section 82 of the diaphragm forming member 80 and has the substantially same rectangular plate shape as that of the diaphragm forming member 80 in a plan view.

As shown in FIGS. 13 and 14, on the upper surface of the passage forming plate 90, the six concave sections 31 are formed in the concave shape at the positions corresponding to the diaphragms 37, the six concave sections 30 are formed in the concave shape at the positions corresponding to the sucking valve bodies 36, and the six concave sections 32 are formed in the concave shape at the positions corresponding to the ejecting valve bodies 38. In the passage forming plate 90, the through-holes 90*a* are formed at the positions corresponding to the ink supply needles 25. The six through-holes 90*a* are arranged in one row at a uniform pitch in the X direction in the gap areas which are the row spaces between the concave sections 31 arranged in two rows. Through-holes 90*a* form a part of the first passage 15*a* and the ink supplied from the ink supply needles 25 are sent to the rear surface of the passage forming plate 90 via the through-holes 90*a*.

As shown in FIGS. 13 and 14, the through-hole 30*b* formed at the eccentric position located outside the valve seat 30*a* protruding at the middle of the concave section is formed in each of the concave sections 30. The through-hole 30*b* forms a part of the first passage 15*a* (see FIGS. 1 and 2) and serves as an inflow passage of the ink flowing from the rear surface of the passage forming plate 90 to the inside (the valve chamber 41*a*) of the sucking valve 41. The through-hole 90*b* is formed in the vicinity of each concave section 30. The through-hole 90*b* forms a part of the second passage 15*b* (see FIGS. 1 and 2) and serves as an outflow passage of the ink from the valve chamber 41*b* of the sucking valve 41 to the rear surface of the passage forming plate 90.

As shown in FIGS. 13 and 14, one pair of through-holes 31*a* and 31*b* are formed in the concave section 31 forming the pump chamber 43*a*. The through-hole 31*a* forms a part of the second passage 15*b* (see FIGS. 1 and 2) and serves as an outflow passage of the ink sucked into the pump chamber 43*a*. On the other hand, the through-hole 31*b* forms a part of the third passage 15*c* (see FIGS. 1 and 2) and serves as an inflow passage of the ink ejected from the pump chamber 43*a*. In each concave section 32, the through-hole 32*b* is formed at the position located in the outer circumference of the valve seat 32*a* located at the middle of the bottom surface of the concave section 32 and having a circular plate shape and the through-hole 32*c* is formed at the middle of the valve seat 32*a*. The through-hole 32*b* forms a part of the third passage 15*c* (see FIGS. 1 and 2) and serves as an inflow passage through which the ink ejected from the pump 43 flows into the ejecting valve 45. On the other hand, the through-hole 32*c* forms a part of the fourth passage 15*d* (see FIGS. 1 and 2) and serves as an outflow passage of the ink flowing from the ejecting valve 45.

As shown in FIGS. 13 and 14, the six through-holes 91*a* (ink discharging holes) and one negative pressure lead-out hole 91*b* are formed in the extension section 91. The six through-holes 91*a* form a part of the fourth passage 15*d* (see FIGS. 1 and 2) and the one negative pressure lead-out hole 91*b* forms a part of the air passage 46*b* (see FIGS. 1 and 2).

In the right upper end of the passage forming plate 90 shown in FIG. 14, a pair of through-holes 90*e* and 90*f* and a groove 90*g* permitting both the through-holes 90*e* and 90*f* to communicate with each other are formed in the vicinity of the right concave section 31 located in the first row. The through-holes 90*e* and 90*f* and the groove 90*g* form a part of the air passage 46*b* (see FIG. 1) for introducing the negative pressure into the negative pressure chamber 43*b*.

In the gap areas which are the row spaces between the concave sections 31 arranged in the two rows, three through-holes 92 are individually formed at the positions corresponding to the nearly central points of the line segments connecting the central points of the three concave sections 31 each paired in the Y direction. The through-holes 92 form a part of the air passage 46*b* and serves as a passage for introducing the negative pressure. The introduced negative pressure reaches the grooves 77 on the rear surface of the cover 70 via the through-holes 81*b* of the diaphragm forming member 80 to be introduced to the two negative pressure chambers 43*b* located on both the side in Y direction via the grooves 77.

As shown in FIGS. 13 and 14, in the peripherals of the concave sections 30, 31, and 32, sealing portions 93*a*, 93*b*, 93*c*, 93*d*, and 93*e* extending in a strip shape so as to be nearly plane-symmetric with the sealing portions 78*a*, 78*b*, 78*c*, 78*d*, and 78*e* of the cover 70 protrude so as to have a width of about 0.5 mm to about 2 mm and a height of about several 10 μm to about several 100 μm, for example. The sealing portions 93*a*, 93*b*, 93*c*, 93*d*, and 93*e* are located to correspond to the sealing portions 83*b*, 84*b*, 85*b*, 86*b*, and 87*b* formed on the rear surface of the diaphragm forming member 80. Upon the assembly of the ink supply system 61, the sealing portions of the diaphragm forming member 80 having rubber elasticity are put and come in pressing contact between the sealing portions of the cover 70 and the sealing portions of the passage forming plate 90 to ensure the sealing property of the concave sections 30, 31, and 32.

Boss sections 94 and 95 having screw insertion holes 94*a* and 95*a* protrude at the positions where the screws 66 and 67 are fastened in the passage forming plate 90, respectively. In the passage forming plate 90, columnar pins 96 having an outer diameter slightly smaller than the inner diameter of the pin hole 89*c* protrude at the positions corresponding to the pin holes 89*c* of the diaphragm member 80. In the passage forming plate 90, positioning holes 97 having an inner diameter slightly larger than the outer diameter of the pin 79 are formed at the positions corresponding to the pins 79 of the cover 70.

The plural (in this embodiment, nineteen) boss sections 94 are inserted into the screw insertion holes 89*a* of the diaphragm forming member 80 and the pins 96 are inserted into the pin holes 89*c*, so that the diaphragm forming member 80 is positioned to the passage forming plate 90 in a state where the sucking valve bodies 36, the diaphragms 37, and the ejecting valve bodies 38 face the concave sections 30, 31, and 32, respectively. In addition, the pins 79 of the cover 70 are inserted into the positioning holes 97, so that the cover 70 is positioned to the passage forming plate 90 and the diaphragm forming member 80 is positioned to the passage forming plate 90.

Here, the protruding height of the boss sections 94 and 95 are set such that a gap between the passage forming plate 90 and the cover 70 is regulated to a predetermined value by bringing the upper end surface of the boss sections 94 and 95 into contact with the rear surface of the cover 70 upon fastening the screws 66. That is, when the screws 66 are fastened, the sealing portions 83*a*, 83*b*, 84*a*, 84*b*, 85*a*, 85*b*, 86*a*, 86*b*, 87*a*, and 87*b* of the diaphragm forming member 80 are put and come in pressing contact between the sealing portions 93*a*, 93*b*, 93*c*, 93*d*, and 93*e* of the passage forming plate 90 and the sealing portions 78*a*, 78*b*, 78*c*, 78*d*, and 78*e* of the cover 70 to ensure the sealing property. At this time, the boss sections 94 and 95 regulate distortion of the sealing portions so that the sealing portions 83*a*, 83*b*, 84*a*, 84*b*, 85*a*, 85*b*, and the like of the diaphragm forming member 80 are deformed due to excessive pressing even when the screws 66 are fastened too strongly. That is, the protruding height of the boss sections 94 and 95 is set to a value which does not cause the excessive pressing and deformation of the sealing portions 83*a*, 83*b*, 84*a*, 84*b*, 85*a*, 85*b*, and the like, by regulating the gap of the sealing portions of the passage forming plate 90 and the cover 70 so as not to be a value smaller than a predetermined value upon bringing the boss sections 94 and 95 into contact with the rear surface of the cover 70 even when the screws 66 are fastened by an excessive fastening force. Moreover, the protruding height of the boss sections 94 and 95 is set so as to compress the sealing portions 83*a*, 83*b*, 84*a*, 84*b*, 85*a*, 85*b*, and the like of the diaphragm forming member 80 to an appropriate deforming degree to ensure an appropriate sealing property until the end surfaces of the boss sections 94 and 95 come in contact with the rear surface of the cover 70 during fastening the screws 66.

In the passage forming plate 90, a notch 98 is formed at the position corresponding to the notch 88*a* of the diaphragm forming member 80. An inclined surface inclined at a predetermined angle and gradually extending outward on the lower side is formed on the bottom surface of the notch 98.

Next, the configuration of the rear surface (the bottom surface) of the passage forming plate 90 will be described. As shown in FIG. 15, on the rear surface of the passage forming plate 90, a partition wall 100 forming side walls of the passages 15*a* to 15*d* and 46*b* (see FIGS. 1 and 2) extends along a predetermined passage path. The partition wall 100 is closed in the shape of a blind passage in all passages 15*a* to 15*d* and 46*b*. Plural grooves (hereinafter, referred to as "a first groove 101 to a fifth groove 105) formed such that a gap (which is a gap of adjacent portions extending substantially parallel) is a groove width are formed in the partition wall 100. In this embodiment, as shown in FIG. 16, by welding the film 120 onto the passage forming surface (the bottom surface) of the passage forming plate 90, the spatial areas surrounded by the first groove 101 to the fifth groove 105 and the film 120 serve as passages 111 to 115 passing through the rear surface of the passage forming plate 90. At this time, the four kinds of first groove 101 to fourth groove 104 serve as the first ink passage 111 to the fourth ink passage 114, respectively, and are provided in each of the six ink supply devices 14. The other one kind of fifth groove 105 serves as the air passage 115 and one groove is provided in a passage passing through the vicinity of the negative pressure chamber 43*b* of each of the six ink supply devices 14.

In one corner of the rear surface of the passage forming plate 90, one negative pressure introducing tube 106 protrudes vertically from the rear surface. One end of the air passage pipe 46*a* connected to the negative pressure generating device 47 is connected to the negative pressure introducing tube 106. The negative pressure introducing tube 106 serves as a port for introducing negative pressure to the ink supply system 61. The air passage groove 105 extends in a passage formed from the negative pressure introducing tube 106 to the negative pressure lead-out hole 91*b* via three through-holes 92.

A pair of pins 107 positioning the protective plate 130 to the passage forming plate 90 protrude at the upper right and left positions of the rear surface of the passage forming plate 90 in FIG. 15. An extension section 108 having the substantially same height of that of the partition wall 100 is formed in the nearly whole circumference of the rear surface of the passage forming plate 90.

As shown in FIG. 16, the film 120 is formed in a substantially rectangular shape having almost the same circumference as that of the passage forming plate 90, and welded to the end surfaces (the upper end surface in FIG. 16) of the partition wall 100 and the extension section 108. The film 120 is formed of a lamination film formed by interposing a metal plate such as an aluminum plate between resin layers. The welding to the passage forming plate 90 is ensured due to the resin layer (for example, thermoplastic resin) of the front surface. Moreover, the film 120 includes an extension section 121 corresponding to the extension section 91 of the passage forming plate 90 and concave portions 120*a* and 120*b* for avoiding the tube 106 and the pins 107 of the passage forming plate 90, respectively.

Figure 17:
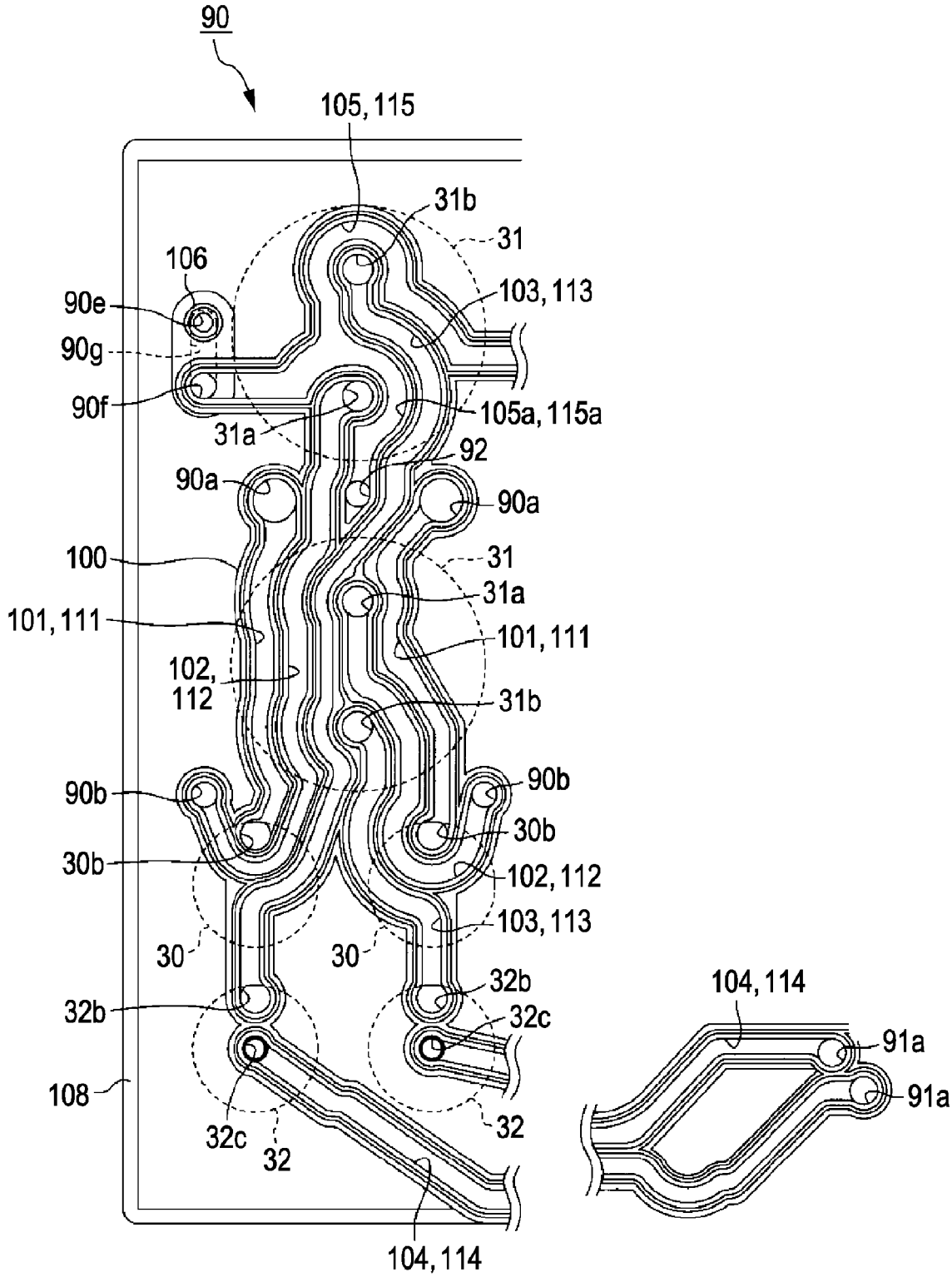
FIG. 17 is a partial bottom view for explaining an ink passage of the passage forming plate.
Figure 18:
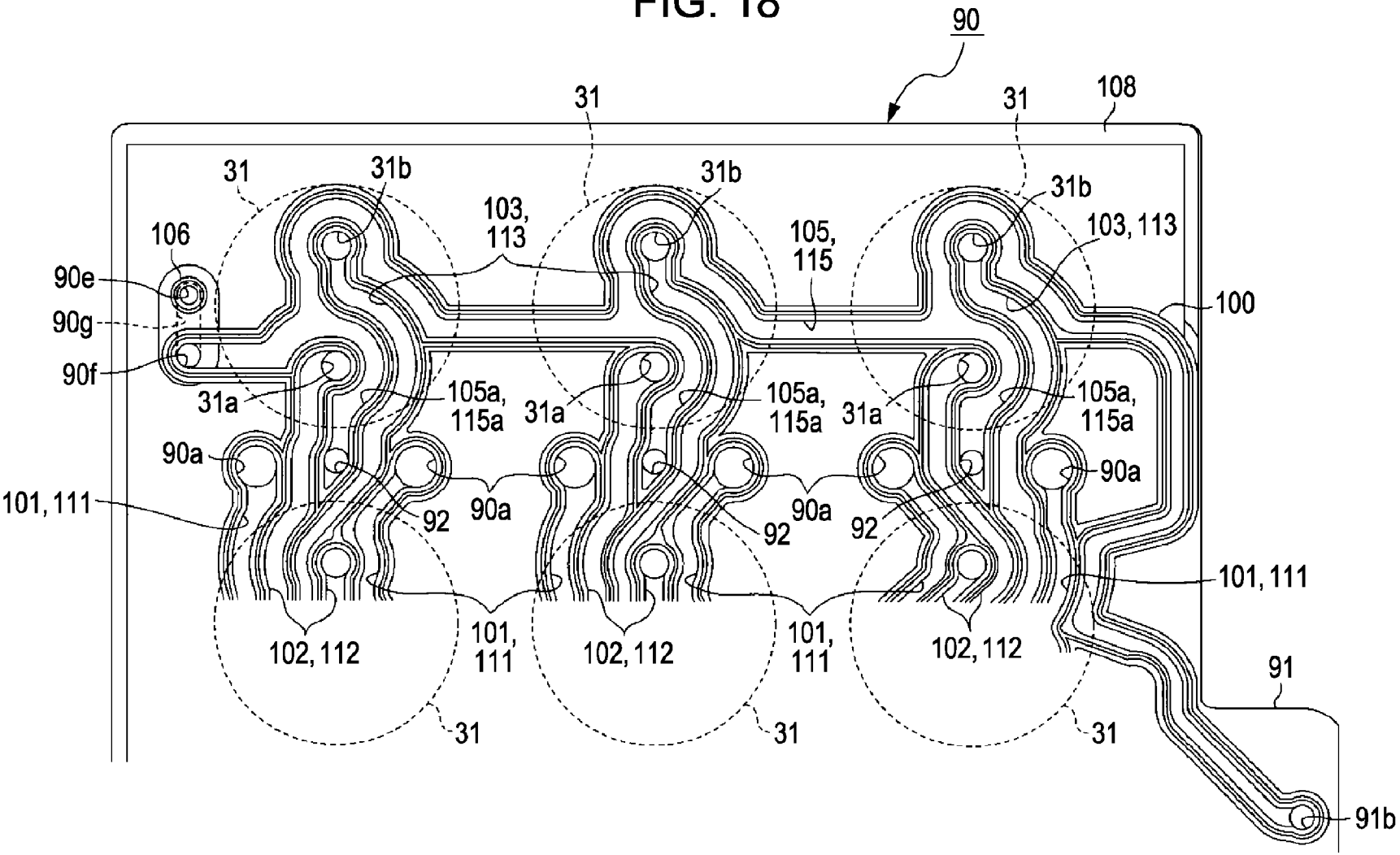
FIG. 18 is a partial bottom view for explaining an air passage of the passage forming plate.

FIG. 17 is a partial bottom view illustrating a portion associated with an ink passage on the rear surface of the passage forming plate. FIG. 18 is a partial bottom view mainly illustrating the air passage on the rear surface of the passage forming plate. In FIGS. 17 and 18, the portions (the boss sections, etc.) other than the passages (the grooves) are not illustrated. In FIG. 17, the portions corresponding to the two ink supply devices 14 are illustrated. Here, like FIG. 15, in FIGS. 17 and 18, reference numerals are given to the passages corresponding to the grooves. In the following description, the groove 101 is considered to be the passage formed after the film welding for explanation.

As shown in FIGS. 15 and 17, the first ink passage groove 101 to the fourth ink passage groove 104 are surrounded by spaces with the film 120 welded onto the rear surface of the passage forming plate 90 to serve as the first ink passage 111, the second ink passage 112, the third ink passage 113, and the fourth ink passage 114, respectively.

As for six groups of the ink passages 111 to 114 forming each of the six ink supply devices 14, since the location relation of the ink supply needles 25, the pump 43, the sucking valves 41, and the ejecting valves 45 is slightly different from each other in the ink supply device 14 in which the pumps 43 are located in the first row and the ink supply device 14 in which the pumps 43 are located in the second row, the passage path and the like are slightly different in each of the ink supply devices 14. However, the groups of the ink passages 111 to 114 basically have the same configuration, except for the slightly different paths. Accordingly, in FIG. 17, the ink passages will be described focusing the two ink supply devices 14 located opposite the pipe connection section 63 (see FIGS. 3 and 4).

In FIG. 17, the upper-side concave section 31 of the two concave sections 31 arranged in the upper and lower sides and the left concave sections 30 and 32 among the concave sections 30 and 32 arranged right and left correspond to one ink supply device 14. The lower-side concave section 31 and the right concave sections 30 and 32 correspond to the other ink supply device 14.

As shown in FIG. 17, the first ink passage 111 (the first groove 101) is a passage permitting the through-hole 90*a* corresponding to the ink supply needle 25 to communicate with the through-hole 30*b* of the sucking valve 41 (the concave section 30). Accordingly, upon the sucking drive of the pump 43, the ink flowing from the ink supply needle 25 to the rear surface of the passage forming plate 90 via the through-hole 90*a* flows to the through-hole 30*b* via the first ink passage 111 and then flows from the through-hole 30*b* to the sucking valve 41.

The second ink passage 112 is a passage permitting the through hole 90*b* in the vicinity of the sucking valve 41 (the concave section 30) to communicate with the through-hole 31*a* of the pump 43 (the concave section 31). Accordingly, upon the sucking drive of the pump 43, the ink flowing from the through-hole 90*b* to the rear surface of the passage forming plate 90 via the sucking valve 41 which has been opened by the ink pressure (the negative pressure) caused by the sucking drive flows to the through-hole 31*a* via the second ink passage 112 and then flows from the through-hole 31*a* to the pump chamber 43*a*.

The third ink passage 113 is a passage which permits the through-hole 31*b* of the pump 43 (the concave section 31) to communicate with the through-hole 32*b* of the ejecting valve 45 (the concave section 32). Accordingly, upon the ejecting drive of the pump 43, the ink ejected from the pump chamber 43*a* and flowing from the through-hole 31*b* to the rear surface of the passage forming plate 90 flows to the through-hole 32*b* via the third ink passage 113 and then flows from the through-hole 32*b* to the ejecting valve 45.

The fourth ink passage 114 serves as a passage which permits the through-hole 32*c* of the ejecting valve 45 (the concave section 32) to communicate with the through-hole 91*a* of the extension section 91. Accordingly, upon the ejecting drive of the pump 43, the ink flowing from the through-hole 32*c* to the rear surface of the passage forming plate 90 via the ejecting valve 45 which has been opened by the ink pressure pressurized by the ejecting drive flows to the through-hole 91*a* via the fourth ink passage 114 and then flows from the ink discharging port 64 of the pipe connection section 63 via the through-hole 91*a*.

Next, the air passage to which the negative pressure is introduced will be described. As shown in FIG. 18, the negative pressure from the negative pressure introducing tube 106 is introduced to the air passage 115 on the rear surface via the groove 90*g* and the through-hole 90*f* of the passage forming plate 90. The air passage 115 extends from the through-hole 90*f* to the negative pressure lead-out hole 91*b* sequentially through the positions corresponding to the rear surface of the pump chambers 43*a* (the concave sections 31) of the pumps 43 arranged in the first row. Moreover, the air passage 115 includes three air passages 115*a* diverged from the positions individually corresponding to the rear surface of the pump chambers 43*a* (the concave sections 31) to extend toward the lower side of FIG. 18. The air passage 115 communicates with the three through-holes 92 individually corresponding to the diverged three air passages 115*a*. Accordingly, the negative pressure introduced into the air passage 115 via the tube 106 of the ink supply system 61 upon the sucking drive of the pumps 43 is led out from the through-holes 92 to the front surface of the passage forming plate 90 via the diverged air passages 115*a*. In addition, the negative pressure led out from the through-holes 92 reaches the middle portion in the length direction of the grooves 77 of the rear surface of the cover 70 via the through-holes 81*b* of the diaphragm forming member 80 and then is introduced along the grooves 77 to the two negative pressure chambers 43*b* located on both the sides in the length direction.

Figure 19:
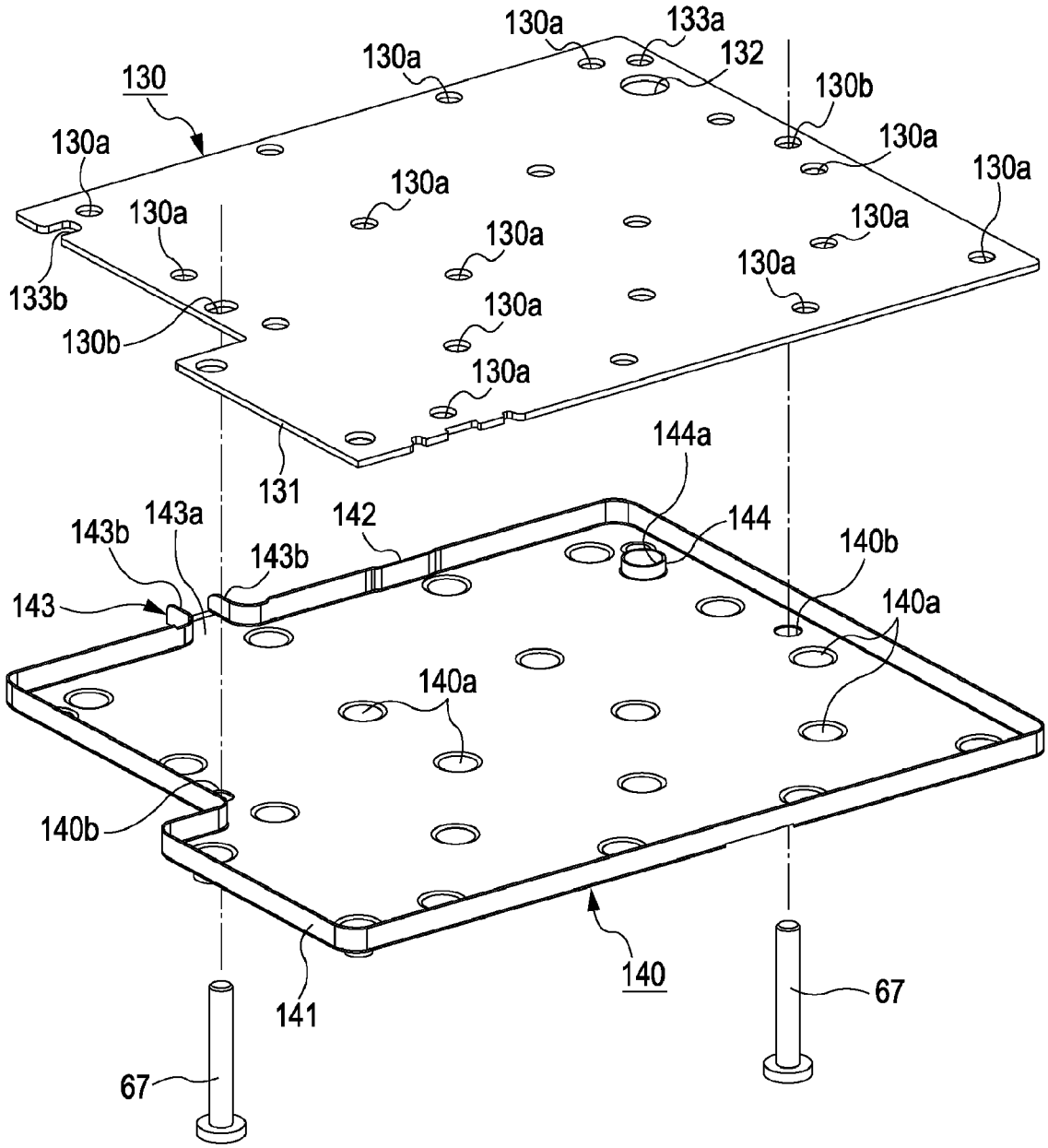
FIG. 19 is an exploded perspective view illustrating a receiving plate and a protective plate.

FIG. 19 is an exploded perspective view illustrating the protective plate and the receiving plate. The protective plate 130 shown in FIG. 19 is formed of a metal plate, for example, having almost the same outer circumferential shape as that of the film 120. The protective plate 130 includes an extension section 131 corresponding to the pipe connection section 63 and plural screw holes 130*a* and 130*b* at the fastening positions of the screws 66 and 67. In addition, a hole 132 for inserting the tube 106 is formed at the position corresponding to the tube 106 of the passage forming plate 90 on a side of the protective plate 130.

The receiving plate 140 includes an extension section 141 which has almost the same outer circumferential shape of that of the protective plate 130 and corresponds to the pipe connection section 63. An extension section 142 having a predetermined height from the bottom surface is formed in the nearly whole circumference of the receiving plate 140. In the extension section 142 of the receiving plate 140, a drain passage 143 (a drain unit) extending outward is provided at the position corresponding to the notch 88*a* of the diaphragm forming member 80. The drain passage 143 includes a passage surface 143*a* which has a predetermined width and is formed as an inclined surface gradually lowered to the outside so as to discharge the waste ink accumulated in the receiving plate and a pair of guides 143*b* which extends by bending the extension section 142 outward along both the sides of the passage surface 143*a*. A flowing direction of the discharged waste ink is guided by the guides 143*b* so that the waste ink flows on the passage surface 143*a*. In the receiving plate 140, a cylindrical portion 144 for inserting the negative pressure introducing tube 106 protrudes at the position corresponding to the hole 132 of the protective plate 130. In the receiving plate 140, plural circular concave portions 140*a* which can allow the front ends of the screws 66 threaded into the screw holes 130*a* protruding toward the rear surface of the protective plate 130 to avoid the interference with the receiving plate 140 are formed at the positions corresponding to the screw holes 130*a* of the protective plate 130. In the receiving plate 140, screw insertion holes 140*b* for inserting the screws 67 are formed at the positions corresponding to the screw holes 130*b* of the protective plate 130.

The lamination structure constituted by the members 70, 80, 90, 120, and 130 is assembled in a state where the sealing property of the members 70, 80, and 90 is ensured, by laminating the members 70, 80, and 90 after the film 120 is welded on the rear surface of the passage forming plate 90 in advance and by tightening the screws 66 inserted into the insertion holes by a predetermined fastening force. In addition, the ink supply system 61 can be assembled by laminating the receiving plate 140 on the bottom surface of the lamination structure in the state where the negative pressure introducing tube 106 is inserted into the cylindrical portion 144 and by inserting the two screws 67 into the screw insertion holes to fasten the receiving plate from the lower side.

At this time, by inserting the boss sections 94 and 95 and the pins 96 of the passage forming plate 90 into the screw insertion holes 89*a* and the pin holes 89*c* of the diaphragm forming member 80, respectively, in the laminated state of the members 70, 80, 90, 120, and 130 before the screw fastening, the diaphragm forming member 80 is positioned to the passage forming plate 90 in the state where the sucking valve bodies 36, the diaphragms 37, and the ejecting valve bodies 38 face the concave sections 30, 31, and 32, respectively. In addition, by inserting the pins 79 into the positioning holes 97, the cover 70 is positioned to the passage forming plate 90 in the state where the sucking valve bodies 36, the diaphragms 37, and the ejecting valve bodies 38 face the concave sections 33, 34, and 35, respectively.

When the laminated members 70, 80, 90, 120, and 130 are tightened by the screws 66, the boss sections 94 and 95 of the passage forming plate 90 come in contact with the rear surface of the cover 70 and a predetermined gap is ensured between the cover 70 and the passage forming plate 90. In this case, the height of the boss sections 94 and 95 is set such that the sealing portions 83*a* to 87*a* and the sealing portions 83*b* to 87*b* of the diaphragm forming member 80 interposed between the sealing portions 78*a*, 78*b*, 78*c*, 78*d*, and 78*e* and the sealing portions 93*a*, 93*b*, 93*c*, 93*d*, and 93*e* are pressed upon fastening the screws 66 by a sealing ensuring force so as not to be excessively pressed and deformed. Accordingly, even when the screws 66 are further tightened after the boss sections 94 and 95 come in contact with the rear surface of the cover 70 by fastening the screws 66, the sealing portions 83*a* to 87*a* and the sealing portions 83*b* to 87*b* of the diaphragm forming member 80 are regulated so as not to be deformed. Therefore, the sealing portions 83*a* to 87*a* and the sealing portions 83*b* to 87*b* are pressed to an appropriate degree without the excessive press.

For example, in a configuration in which the sealing portions 84*a*, 84*b*, 85*a*, and 85*b* surrounding the sucking valve bodies 36 and the ejecting valve bodies 38 in the diaphragm forming member 80 are excessively pressed and deformed when the screws 66 are too strongly tightened, the rubber pressed and deformed is extruded to the inside of the valve chamber and the sucking valve bodies 36 or the ejecting valve bodies 38 are deformed and become loose. As a consequence, non-uniformity in opening or closing time of the valve body caused by whether or not the valve body is loose may occur due to non-uniformity in the tightening force of the screws 66.

In this case, for example, the opening or closing time of the sucking valve body may become different and the sucking valve 41 which has to be closed when the negative pressure chamber 43*b* is opened to the air may not be completely closed. Moreover, when the ink cartridge 13 is detached in such a situation, the ink pressurized in the ink supply system may flow backward and thus the ink may leak from the ink supply needle 25. In the configuration according to this embodiment, however, since the sealing portions 84*a* and 84*b* of the diaphragm forming member 80 is not excessively pressed and deformed, the non-uniformity in the opening or closing time of the sucking valve body 36 rarely occurs. In addition, when the negative pressure chamber 43*b* is opened to the air, the sucking valve 41 is completely closed. As a consequence, when a user detaches the ink cartridge 13, the ink can be prevented from leaking from the ink supply needle 25 because the ink pressurized in the ink supply system 61 flows backward and thus the sealing portions 84*a* and 84*b* are excessively pressed and deformed.

When the ejecting valve 45 is not fully closed and ink leakage occurs, non-uniformity in an amount of ink flowing between the ink passages of ink colors occurs. In the configuration according this embodiment, however, since the sealing portions 85*a* and 85*b* of the diaphragm forming member 80 is not excessively pressed and deformed, the non-uniformity in the opening or closing time of the ejecting valve body 38 rarely occurs. In addition, the ejecting valve 45 is surely closed upon the sucking drive of the pump 43. As a consequence, since the closed state of the ejecting valve 45 is ensured and the ink leakage does not occur, the non-uniformity in the amount of ink flowing between the ink passages of ink colors rarely occurs.

In this way, the excessive pressing and deformation of the sealing portions can be prevented. However, when an urging force for closing the sucking valve body 36 and the ejecting valve body 38 is weak, the ink leakage in the sucking valve 41 and the ejecting valve 45 may occur, the ink leakage from the ink supply needle 25 upon detaching or mounting the above-described ink cartridge 13 may occur, and the non-uniformity in the amount of ink flowing between the ink passages may occur. In order to solve these problems, a check valve configuration having the coil springs 40 and 44 (the urging members) urging the sucking valve body 36 and the ejecting valve body 38 in the valve closing direction is intentionally used to ensure the closed state of the valve, even though the size of the sucking valve 41 and the ejecting valve 45 is increased.

Even though the size of the sucking valve 41 and the ejecting valve 45 is increased, the compact ink supply system 61 is configured by disposing the six pumps 43, the six sucking valves 41, and the six ejecting valves 45 constituting the six ink supply devices 14 on the same plane in the main body 62 of the ink supply system 61 in a relatively precise manner. In this case, the pumps 43 having the relatively large diameter are arranged in two rows, the six ink supply needles 25 are arranged in one row at the same interval in the spatial areas between the rows of the pumps, the six sucking valves 41 and the six ejecting valves 45 are arranged in one row in the direction parallel to the rows of the pumps in the areas adjacent to the rows of the pumps.

In this layout, the pumps 43 and the valves 41 and 45 are precisely arranged, but the positions of the ink supply needles 25, the pumps 43, and the valves 41 and 45 may be relatively distant from each other. Therefore, the passages 15*a*, 15*b*, 15*c*, and 15*d* may be relatively lengthened. In this embodiment, however, the passages 15*a*, 15*b*, 15*c*, and 15*d* surrounded by the grooves 101 to 104 and the film 120 are disposed on the rear surface opposite to the surface (the front surface) of the passage forming plate 90 provided with the pumps 43 and the valves 41 and 45, by providing the plural grooves 101 to 104 on the rear surface of the passage forming plate 90 and welding the film 120 on the rear surface thereof. With such a configuration, the passages 15*a*, 15*b*, 15*c*, and 15*d* can be assembled in one same component without sacrificing the relatively precise layout of the pumps 43 and the valves 41 and 45.

Figure 20:
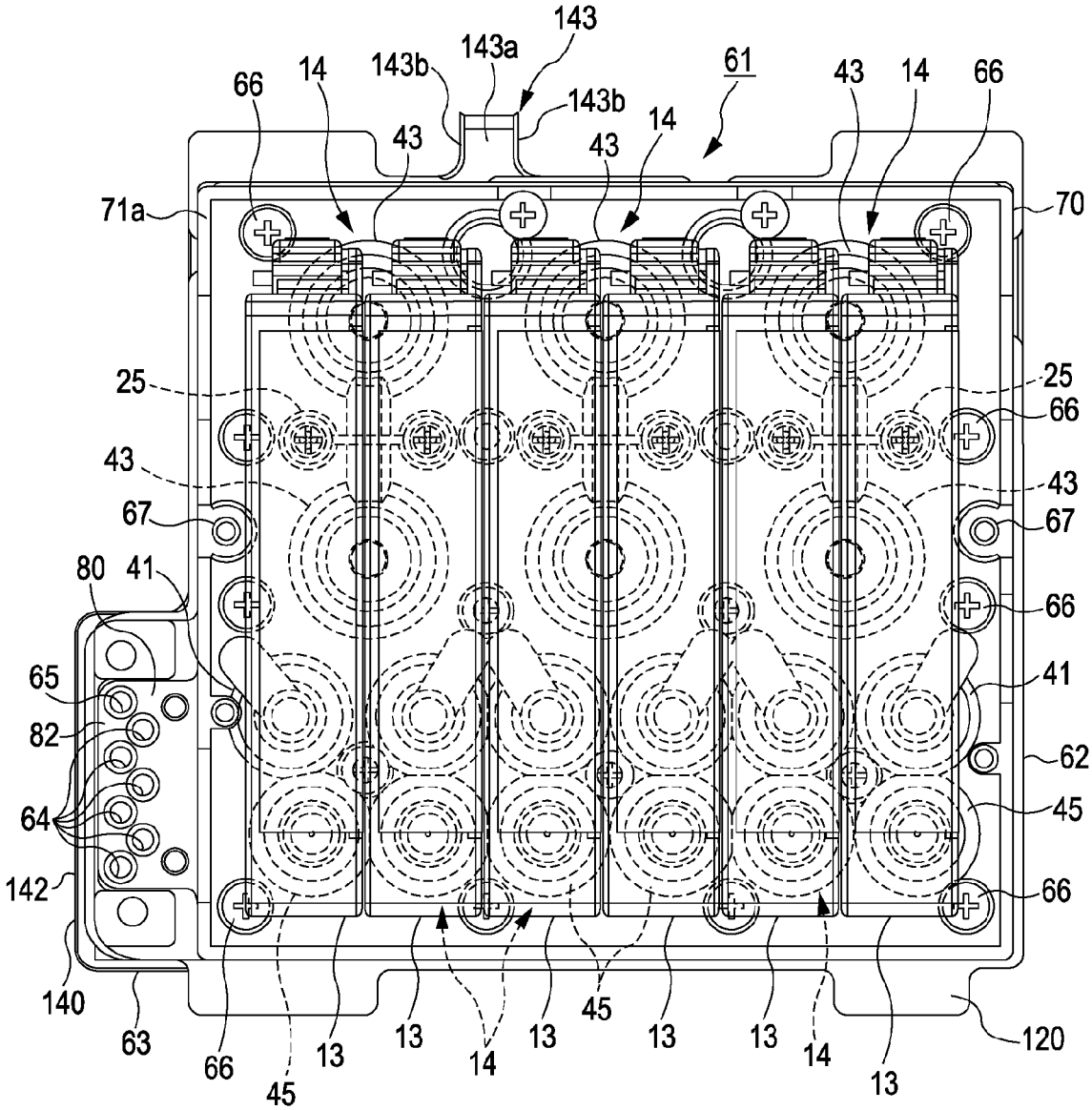
FIG. 20 is a plan view illustrating the ink supply system mounted with the ink cartridge.

FIG. 20 is a plan view illustrating the ink supply system 61 mounted with the six ink cartridges 13. Assuming that a projection range obtained by projecting an area (a minimum rectangular area containing the six ink cartridges 13 in a plan view of FIG. 20) for disposing the six ink cartridges 13 on the upper surface of the ink supply system 61 in the lamination direction is "a cartridge projection range", as shown in FIG. 20, the six pumps 43 are laid out relative to the positions of the six ink supply needles 25 such that all the central points of the pumps fall within the cartridge projection range. The six sucking valves 41 arranged in one row are laid out relative to the positions of the six ink supply needles 25 such that all the central points of the sucking valves fall within the cartridge projection range. The six ejecting valves 45 arranged in one row are also laid out relative to the positions of the six ink supply needles 25 such that all the central points of the ejecting valves fall within the cartridge projection range. That is, in this embodiment, the six pumps 43, the six sucking valves 41, and the six ejecting valves 45 are laid out such that all the central points thereof fall within the cartridge projection range determined by the positions of the six ink supply needles 25.

The main body 62 having a relatively compact size is configured to include screw fastening boss sections 75 and 76 and an extension section 71*a* in the outer circumference formed by laying out the six ink supply needles 25, the six pumps 43, the six sucking valves 41, and the six ejecting valves 45 in the relatively precise manner. The cartridge projection range is within the upper surface of the compact main body 62. With such a configuration, a space required to dispose the ink supply system 61 (the cartridge holder) and the six ink cartridges 13 in the printer 11 can be restrained so as to be relatively small. As a consequence, it is possible to make the printer 11 compact.

Since the protective plate 130 formed of a metal plate is disposed on the lower side of the film 120, the passage forming plate 90 made of a plastic material can be prevented from being deformed in a rippling shape due to the distribution of a force particularly strongly pushed in the tightened positions of the screws 66 upon tightening the screws 66. Accordingly, even when the screws 66 is fastened, it is possible to prevent the sealing performance from deteriorating due to the guarantee of the flatness of the passage forming plate 90, for example, or prevent the non-uniformity in the opening or closing time of the valve body from occurring.

The waste ink leaking in the peripheral of the ink supply needle 25 on the upper surface of the cover 70 upon mounting or detaching the ink cartridge 13 may flow onto the diaphragm forming member 80 located on the rear surface of the cover 70 via the through-hole 68. In addition, the waste ink accumulated on the upper surface of the diaphragm forming member 80 flows to the outside via the notch 88*a*, flows to the lower side along the notch 98 of the side wall of the passage forming plate 90 to drop to the drain passage 143 of the receiving plate 140, and is discharged to the outside along the drain passage 143 to be collected in the waste liquid tank 21.

Even though the ink leaks from the sealing portions between the cover 70 and the diaphragm forming member 80 and the sealing portions between the diaphragm forming member 80 and the passage forming plate 90, the leaking ink flows and drops from the notch 88*a* to the outside and is likewise collected in the waste liquid tank 21, for example, via the drain passage 143. Accordingly, it is possible to prevent the inside of the printer 11 from being smeared due to the waste ink leaking from the ink supply system 61.

As described in detail above, the following advantages can be obtained according to this embodiment.

(1) After the ink flows into the pump chamber 43*a* from the upstream side on the side of the ink cartridge 13 by driving the negative pressure generating device 47, the pump chamber 43*a* can be permitted to become the pressurized state by stopping the drive of the negative pressure generating device 47 and applying the urging force of the coil spring 42 to the diaphragm 37. Accordingly, an ejection pressure for ejecting the ink from the pump chamber 43*a* can be obtained. Since a force pushing the mixed bubbles is applied, the bubbles can be prevented from remaining in the pump chamber 43*a*. When the bubbles remain in the pump chamber 43*a*, the bubbles may be increased by the air or the like flowing from the upstream side. However, by preventing the bubbles from remaining, the bubbles can flow to the downstream side without being increased.

(2) The first passage forming member 27 which forming the pump chamber 43*a* is formed of a plastic material which has a gas permeable property. However, upon the drive of the negative pressure generating device 47, that is, at time other than the time of the sucking drive of the pump 43, the pump chamber 43*a* can be normally maintained in the pressurized state by the urging force of the coil spring 42. Accordingly, it is possible to prevent the air from permeating through the wall surface and entering the pump chamber 43*a* and the air mixed in the pump chamber 43*a* is discharged to the outside of the liquid supply passage.

(3) When the printing ends, the driving motor 49 is driven to rotate forward to perform the sucking drive of the pump 43 and then the driving motor 49 is driven to rotate backward to allow the negative pressure chamber 43*b* to open to the air. Therefore, the pump chamber 43*a* can be maintained in the pressurized state by the urging force of the coil spring 42, while the printer 11 is turned off. Accordingly, it is possible to sufficiently guarantee a time period of discharging the air and remove the bubbles mixed in the pump chamber 43*a* without the flow of the bubbles to the downstream side.

(4) The sucking valve 41 permitting the ink to pass from the upstream side to the downstream side is provided on the upstream side of the pump chamber 43*a* in the ink passage 15. Therefore, even when the pump chamber 43*a* is maintained in the pressurized state, it is possible to prevent the ink from flowing backward to the upstream side. In addition, the ejecting valve 45 permitting the ink to pass from the upstream side to the downstream side is provided on the downstream side of the pump chamber 43*a*. Therefore, when the ink flows into the pump chamber 43*a* from the upstream side by driving the negative pressure generating device 47, it is possible to prevent the ink from flowing backward from the downstream side to the pump chamber 43*a*.

(5) The passage plate 17*d* which is normally in the valve-closed state and becomes the valve-opened state when the downstream side is depressurized to the pressure equal to or less than the predetermined pressure by the consumption of the ink is provided on the downstream side of the ejecting valve 45 in the ink passage 15. Therefore, when the passage plate 17*d* is in the valve-closed state even in the case of maintaining the pump chamber 43*a* in the pressurized state, the ink is not supplied to the downstream side (to the printing head 12). When the downstream side is depressurized to the pressure equal to or less than the predetermined pressure by the consumption of the ink, the passage plate 17*d* becomes the valve-opened state. Therefore, it is possible to supply the ink in accordance with the consumption of the ink on the downstream side.

(6) By driving the negative pressure generating device 47 and generating the negative pressure in the negative pressure chamber 43*b*, it is possible to displace the diaphragm 37 toward the negative pressure chamber 43*b* and allow the ink to flow into the pump chamber 43*a* from the upstream side. Moreover, by allowing the air opening mechanism 48 to open the negative pressure chamber 43*b* to the air upon stopping the drive of the negative pressure generating device 47 and applying the urging force of the coil spring 42 to the diaphragm 37, it is possible to permit the pump chamber 43*a* to become the pressurized state.

Here, when the drive of the actuator stops in the case of pressurizing the coil spring 42 by the actuator, for example, to decrease the volume of the pump chamber 43*a*, the pump chamber 43*a* cannot be maintained in the pressurized state. When the pump chamber 43*a* becomes the pressurized state by the pressurizing force of the pressurized air, the pressurizing force may become weak due to the leakage of the pressurized air after the drive of the pressurizing device stops. However, by allowing the coil spring 42 to urge the diaphragm 37, the pressurized state can be maintained without weakening the pressurizing force. That is, by stopping the drive of the negative pressure device 47 and allowing the air opening mechanism 48 to open the negative pressure chamber 43*b* to the air after the negative pressure is generated in the negative pressure chamber 43*b* by driving the negative pressure generating device 47, it is possible to maintain the pump chamber 43*a* in the pressurized state even upon stopping the drive of the negative pressure generating device 47.

(7) The lamination structure is formed such that the first passage forming member 27 forming the ink passages 15*a*, 15*b*, 15*c*, and 15*d* and the pump chambers 43*a* and the second passage forming member 28 forming the negative pressure chambers 43*b* interpose the flexible member 29. Therefore, it is possible to make the liquid supply device 14 or the printer 11 compact and save a space. Moreover, the assembling work is simplified.

(8) Since the coil spring 42 is provided in the negative pressure chamber 43*b*, it is possible to urge the diaphragm 37 without the contact with the ink. Accordingly, it is possible to prevent an unnecessary chemical change from occurring due to the coil spring 42 being in contact with the liquid. When the coil spring 42 is present in the pump chamber 43*a*, bubbles may be trapped in the coil spring 42 and thus it is difficult to discharge the bubbles even by cleaning. However, since the coil spring 42 is provided outside the pump chamber 43*a*, it is possible to prevent the bubbles from remaining in the pump chamber 43*a*.

The above-described embodiments may be modified into the following embodiments.

The first passage forming member 27 and the passage forming plate 90 may be formed of polypropylene (PP), for example, having a low gas permeable property. Even in this case, by maintaining the pump chamber 43*a* in the pressurized state, it is possible to prevent the air from permeating through the wall surface and entering the pump chamber 43*a*.

The displacement member may have another configuration as long as the displacement member is displaceable to increase or decrease the volume of the pump chamber 43*a*.

For example, the volume of the pump chamber 43*a* may be changed by a piston which can reciprocate in the pump chamber 43*a*.

The urging force of the coil spring 42 is applied to the diaphragm 37 by immediately opening the negative pressure chamber 43*b* to the air. For example, the pressurizing force may be adjusted by gradually opening the negative pressure chamber to the air.

The urging member is not limited to the coil spring 42. For example, a rubber member as the urging member may be integrally formed with the film member as a flexible member to obtain the urging force.

The coil spring 42 may be formed as a pulling spring so as to be disposed in the pump chamber 43*a*.

The ink supply device 14 is not limited to the ink supply system 61 assembled by laminating the first passage forming member 27, the second passage forming member 28, and the flexible member 29, but may be formed by individually connecting a pump, a unidirectional valve, or the like to a tube as the liquid supply passage.

The diaphragm forming member 80 may not be formed as a member shared by all the ink supply devices 14 in the printer 11. For example, plural diaphragm forming members may be formed in one ink supply system 61.

The ink supply device including the pumps, the first unidirectional valves (the sucking unidirectional valves), and the second unidirectional valves (the ejecting unidirectional valves) may be mounted on the printing head unit. That is, the ink supply system 61 may be mounted on a carriage. Even in this configuration, it is possible to reduce the piping work and make the ink supply device thin by using the ink supply system 61 having the lamination structure.

In the above-described embodiment, the ink jet printer and the ink cartridge have been used. However, a liquid ejecting apparatus discharging or ejecting another liquid other than ink and a liquid storing unit storing the liquid may be used. The invention is useful for various liquid ejecting apparatuses including a liquid ejecting head for ejecting minute liquid droplets. The liquid droplet refers to a liquid ejected from the liquid ejecting apparatus and includes a liquid having a particle shape, a liquid having a droplet shape, and a liquid having a thread trailing shape. The liquid is a material which can be ejected by the liquid ejecting apparatus. For example, the liquid is a matter in a liquefied state and includes a liquid of a fluid state such as a liquid-like material having high or low viscosity, sol, gel water, other inorganic solvents, an organic solvent, liquid solution, liquid-like resin, and liquid-like metal (metallic melt), a liquid in one state of a matter, and a liquid in which particles of a functional material formed of a solid matter such as colorant or metal particle is dissolved, dispersed, or mixed. Representative examples of a liquid are ink or liquid crystal, as described in the embodiment. Here, the ink includes a liquid composition such as general water-based ink, general oil-based ink, gel ink, and hot-melt ink. Specific examples of the liquid ejecting apparatus include a liquid crystal display, an EL (electro-luminescence) display, a plane emission display, a liquid ejecting apparatus ejecting a liquid containing a material such as an electrode material or a color material used to manufacture a color filter is dispersed or dissolved, a liquid ejecting apparatus ejecting bio organism used to manufacture a bio chip, a liquid ejecting apparatus ejecting a liquid as a sample used by a precise pipette, a printing apparatus, and a micro dispenser. In addition, examples of the liquid ejecting apparatus include a liquid ejecting apparatus ejecting a lubricant to a precision instrument such as a clock or a camera by a pin point, a liquid ejecting apparatus ejecting a transparent resin liquid such as ultraviolet cured resin on a board to form a minute hemispheric lens (an optical lens) used in an optical communication element or the like, and a liquid ejecting apparatus ejecting an acid or alkali etching liquid to etch a board or the like. In addition, the invention is applicable to one liquid ejecting thereof and the liquid storing unit.

What is claimed is:

1. A liquid supply device comprising:

a liquid supply passage which supplies a liquid from an upstream side on which the liquid is supplied from a liquid supply source to a downstream side on which the liquid is consumed;

a pump which is provided with a pump chamber in the liquid supply passage;

a displacement member which forms a part of a wall surface of the pump chamber and is displaceable to increase or decrease the volume of the pump chamber;

an urging member which urges the displacement member in a direction decreasing the volume of the pump chamber; and a displacement mechanism which displaces the displacement member in a direction increasing the volume of the pump chamber against an urging force of the urging member upon driving the displacement mechanism, wherein upon stopping the drive of the displacement mechanism, the pump chamber remains in a pressurized state by the urging force of the urging member.

2. The liquid supply device according to claim 1, further comprising:

a first unidirectional valve which is provided on an upstream side of the pump chamber in the liquid supply passage and permits the liquid to pass from the upstream side to the downstream side;

a second unidirectional valve which is provided on a downstream side of the pump chamber in the liquid supply passage and permits the liquid to pass from the upstream side to the downstream side; and an opening/closing valve which is provided on a downstream side of the second unidirectional valve in the liquid supply passage and which is normally in a valve-closed state and becomes a valve-opened state when the downstream side is depressurized to a pressure equal to or less than a predetermined pressure by consumption of the ink.

3. The liquid supply device according to claim 1, further comprising:

a negative pressure chamber which is provided outside the pump chamber so that the displacement member forms a partition wall along with the pump chamber; and an air opening mechanism which opens the inside of the negative pressure chamber to the air, wherein the displacement mechanism includes a negative pressure generating device generating negative pressure in the negative pressure chamber upon driving the negative pressure generating device, and wherein the displacement member is displaced toward the negative pressure chamber by the negative pressure generated in the negative pressure chamber by driving the negative pressure generating device to allow the liquid to flow into the pump chamber from the upstream side, and the urging force of the urging member is applied to the displacement member by allowing the air opening mechanism to open the negative pressure chamber to the air upon stopping the drive of the negative pressure generating device so that the pump chamber becomes a pressurized state.

4. The liquid supply device according to claim 3, wherein a first forming member for forming the liquid supply passage and the pump chamber and a second forming member for forming the negative pressure chamber are laminated with the displacement member interposed therebetween.

5. The liquid supply device according to claim 1, wherein the urging member is a spring member provided outside the pump chamber.

6. A liquid ejecting apparatus comprising:

a liquid ejecting unit which ejects a liquid; and the liquid supply device according to claim 1 which supplies the liquid to the liquid ejecting unit.

7. A liquid supplying method in a liquid supply device including a pump which is provided with a pump chamber in a liquid supply passage supplying a liquid from an upstream side on which the liquid is supplied from a liquid supply source to a downstream side on which the liquid is consumed, the liquid supplying method comprising:

displacing a displacement member as a part of a wall surface of the pump chamber, which is displaceable to increase or decrease the volume of the pump chamber and urged in a direction decreasing the volume of the pump chamber by an urging member, in a direction increasing the volume of the pump chamber against an urging force of the urging member by driving a displacement mechanism; and pressurizing the pump chamber by applying the urging force of the urging member to the displacement member upon stopping the drive of the displacement mechanism.

* * * * *